US009444143B2

(12) United States Patent
Nomura et al.

(10) Patent No.: US 9,444,143 B2
(45) Date of Patent: Sep. 13, 2016

(54) ANTENNA AND WIRELESS IC DEVICE

(75) Inventors: Masato Nomura, Nagaokakyo (JP); Noboru Kato, Nagaokakyo (JP); Yuya Dokai, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 672 days.

(21) Appl. No.: 13/419,454

(22) Filed: Mar. 14, 2012

(65) Prior Publication Data

US 2012/0169553 A1 Jul. 5, 2012

Related U.S. Application Data

(63) Continuation of application No. PCT/JP2010/063082, filed on Aug. 3, 2010.

(30) Foreign Application Priority Data

Oct. 16, 2009 (JP) ..... 2009-239539
Feb. 18, 2010 (JP) ..... 2010-033699

(51) Int. Cl.
*H01Q 11/12* (2006.01)
*H01Q 7/00* (2006.01)
*H01Q 1/38* (2006.01)
*H01Q 5/371* (2015.01)

(52) U.S. Cl.
CPC ..... *H01Q 7/00* (2013.01); *H01Q 1/38* (2013.01); *H01Q 5/371* (2015.01)

(58) Field of Classification Search
CPC ..... H01Q 11/12
USPC ..... 343/741
See application file for complete search history.

(56) References Cited

U.S. PATENT DOCUMENTS 3,364,564 A 1/1968 Kurtz et al.
4,794,397 A 12/1988 Ohe et al.
5,232,765 A 8/1993 Yano et al.
5,253,969 A 10/1993 Richert (Continued)

FOREIGN PATENT DOCUMENTS

CA 2 279 176 A1 7/1998
CN 101542830 A 9/2009

(Continued)

OTHER PUBLICATIONS

Official Communication issued in International Patent Application No. PCT/JP2009/069486, mailed on Mar. 2, 2010.

(Continued)

*Primary Examiner* — Dameon E Levi
*Assistant Examiner* — Andrea Lindgren Baltzell
(74) *Attorney, Agent, or Firm* — Keating & Bennett, LLP

(57) ABSTRACT

An antenna includes two feeding points, and includes a loop-shaped loop electrode and an auxiliary electrode electrically connected to the loop electrode and located at a position along the outer circumference of the loop electrode. The first end portion of the auxiliary electrode is electrically connected to the vicinity of one feeding point of the loop electrode. The second end portion of the auxiliary electrode is open. A resonant circuit is defined by the auxiliary electrode and the loop electrode to enhance the impedance of the antenna, compared with a case in which the antenna is configured using the simple loop electrode, and it is easy to achieve impedance matching with the wireless IC.

12 Claims, 13 Drawing Sheets

(56) References Cited

U.S. PATENT DOCUMENTS 5,337,063 A 8/1994 Takahira
5,374,937 A 12/1994 Tsunekawa et al.
5,399,060 A 3/1995 Richert
5,491,483 A 2/1996 D'Hont
5,528,222 A 6/1996 Moskowitz et al.
5,757,074 A 5/1998 Matloubian et al.
5,854,480 A 12/1998 Noto
5,903,239 A 5/1999 Takahashi et al.
5,936,150 A 8/1999 Kobrin et al.
5,955,723 A 9/1999 Reiner
5,995,006 A 11/1999 Walsh
6,104,311 A 8/2000 Lastinger
6,107,920 A 8/2000 Eberhardt et al.
6,172,608 B1 1/2001 Cole
6,181,287 B1 1/2001 Beigel
6,190,942 B1 2/2001 Wilm et al.
6,249,258 B1 6/2001 Bloch et al.
6,259,369 B1 7/2001 Monico
6,271,803 B1 8/2001 Watanabe et al.
6,335,686 B1 1/2002 Goff et al.
6,362,784 B1 3/2002 Kane et al.
6,367,143 B1 4/2002 Sugimura
6,378,774 B1 4/2002 Emori et al.
6,406,990 B1 6/2002 Kawai
6,448,874 B1 9/2002 Shiino et al.
6,452,563 B1 9/2002 Porte
6,462,716 B1 10/2002 Kushihi
6,542,050 B1 4/2003 Arai et al.
6,600,459 B2 7/2003 Yokoshima et al.
6,634,564 B2 10/2003 Kuramochi
6,664,645 B2 12/2003 Kawai
6,763,254 B2 7/2004 Nishikawa
6,812,707 B2 11/2004 Yonezawa et al.
6,828,881 B2 12/2004 Mizutani et al.
6,837,438 B1 1/2005 Takasugi et al.
6,861,731 B2 3/2005 Buijsman et al.
6,927,738 B2 8/2005 Senba et al.
6,963,729 B2 11/2005 Uozumi
7,047,555 B1 * 5/2006 Inaguma et al. ..... 725/149
7,088,249 B2 8/2006 Senba et al.
7,088,307 B2 8/2006 Imaizumi
7,112,952 B2 9/2006 Arai et al.
7,119,693 B1 10/2006 Devilbiss
7,129,834 B2 10/2006 Naruse et al.
7,248,221 B2 7/2007 Kai et al.
7,250,910 B2 7/2007 Yoshikawa et al.
7,276,929 B2 10/2007 Arai et al.
7,317,396 B2 1/2008 Ujino
7,405,664 B2 7/2008 Sakama et al.
2002/0011967 A1 1/2002 Goff et al.
2002/0015002 A1 2/2002 Yasukawa et al.
2002/0044092 A1 4/2002 Kushihi
2002/0067316 A1 6/2002 Yokoshima et al.
2002/0093457 A1 7/2002 Hamada et al.
2003/0006901 A1 1/2003 Kim et al.
2003/0020661 A1 1/2003 Sato
2003/0045324 A1 3/2003 Nagumo et al.
2003/0169153 A1 9/2003 Muller
2004/0001027 A1 1/2004 Killen et al.
2004/0001029 A1 * 1/2004 Parsche ..... H01Q 7/00 343/866
2004/0026519 A1 2/2004 Usami et al.
2004/0056823 A1 3/2004 Zuk et al.
2004/0066617 A1 4/2004 Hirabayashi et al.
2004/0217915 A1 11/2004 Imaizumi
2004/0219956 A1 11/2004 Iwai et al.
2004/0227673 A1 11/2004 Iwai et al.
2004/0252064 A1 12/2004 Yuanzhu
2005/0092836 A1 5/2005 Kudo
2005/0099337 A1 5/2005 Takei et al.
2005/0125093 A1 6/2005 Kikuchi et al.
2005/0134460 A1 6/2005 Usami
2005/0134506 A1 6/2005 Egbert
2005/0138798 A1 6/2005 Sakama et al.
2005/0140512 A1 6/2005 Sakama et al.
2005/0232412 A1 10/2005 Ichihara et al.
2005/0236623 A1 10/2005 Takechi et al.
2005/0275539 A1 12/2005 Sakama et al.
2006/0001138 A1 1/2006 Sakama et al.
2006/0032926 A1 2/2006 Baba et al.
2006/0044192 A1 3/2006 Egbert
2006/0055601 A1 3/2006 Kameda et al.
2006/0071084 A1 4/2006 Detig et al.
2006/0109185 A1 5/2006 Iwai et al.
2006/0145872 A1 7/2006 Tanaka et al.
2006/0158380 A1 7/2006 Son et al.
2006/0170606 A1 8/2006 Yamagajo et al.
2006/0214801 A1 9/2006 Murofushi et al.
2006/0220871 A1 10/2006 Baba et al.
2006/0244676 A1 11/2006 Uesaka
2006/0267138 A1 11/2006 Kobayashi
2007/0004028 A1 1/2007 Lair et al.
2007/0018893 A1 1/2007 Kai et al.
2007/0040028 A1 2/2007 Kawamata
2007/0052613 A1 3/2007 Gallschuetz et al.
2007/0057854 A1 3/2007 Oodachi et al.
2007/0069037 A1 3/2007 Kawai
2007/0132591 A1 6/2007 Khatri
2007/0164414 A1 7/2007 Dokai et al.
2007/0200708 A1 * 8/2007 Hayama ..... H01Q 1/2208 340/572.7
2007/0200782 A1 8/2007 Hayama et al.
2007/0229276 A1 10/2007 Yamagajo et al.
2007/0247387 A1 10/2007 Kubo et al.
2007/0252700 A1 11/2007 Ishihara et al.
2007/0252703 A1 11/2007 Kato et al.
2007/0285335 A1 12/2007 Bungo et al.
2007/0290928 A1 12/2007 Chang et al.
2008/0024156 A1 1/2008 Arai et al.
2008/0070003 A1 3/2008 Nakatani et al.
2008/0087990 A1 4/2008 Kato et al.
2008/0143630 A1 6/2008 Kato et al.
2008/0169905 A1 7/2008 Slatter
2008/0184281 A1 7/2008 Ashizaki et al.
2008/0272885 A1 11/2008 Atherton
2009/0002130 A1 1/2009 Kato
2009/0009007 A1 1/2009 Kato et al.
2009/0021352 A1 1/2009 Kataya et al.
2009/0021446 A1 1/2009 Kataya et al.
2009/0065594 A1 3/2009 Kato et al.
2009/0109102 A1 4/2009 Dokai et al.
2009/0160719 A1 6/2009 Kato et al.
2009/0195466 A1 * 8/2009 Tsai ..... H01Q 1/2266 343/741
2009/0201116 A1 8/2009 Orihara
2009/0224061 A1 9/2009 Kato et al.
2009/0231106 A1 9/2009 Okamura
2009/0262041 A1 10/2009 Ikemoto et al.
2009/0266900 A1 10/2009 Ikemoto et al.
2009/0278687 A1 11/2009 Kato
2009/0321527 A1 12/2009 Kato et al.
2010/0103058 A1 4/2010 Kato et al.
2010/0182210 A1 7/2010 Ryou et al.
2010/0283694 A1 11/2010 Kato
2011/0031320 A1 2/2011 Kato et al.
2011/0063184 A1 3/2011 Furumura et al.

FOREIGN PATENT DOCUMENTS

DE 10 2006 057 369 A1 6/2008
EP 0 694 874 A2 1/1996
EP 0 848 448 A2 6/1998
EP 0 948 083 A2 10/1999
EP 0 977 145 A2 2/2000
EP 1 010 543 A1 6/2000
EP 1 085 480 A1 3/2001
EP 1 160 915 A2 12/2001
EP 1 170 795 A2 1/2002
EP 1 193 793 A2 4/2002
EP 1 227 540 A1 7/2002
EP 1 280 232 A1 1/2003
EP 1 280 350 A1 1/2003
EP 1 343 223 A1 9/2003
EP 1 357 511 A2 10/2003

(56) References Cited

FOREIGN PATENT DOCUMENTS

| | | | |
|---|---|---|---|
| EP | 1 547 753 | A1 | 6/2005 |
| EP | 1 548 872 | A1 | 6/2005 |
| EP | 1 626 364 | A2 | 2/2006 |
| EP | 1 701 296 | A1 | 9/2006 |
| EP | 1 703 589 | A1 | 9/2006 |
| EP | 1 742 296 | A1 | 1/2007 |
| EP | 1 744 398 | A1 | 1/2007 |
| EP | 1 841 005 | A1 | 10/2007 |
| EP | 1 865 574 | A1 | 12/2007 |
| EP | 1 887 652 | A1 | 2/2008 |
| EP | 1 976 056 | A1 | 10/2008 |
| EP | 1 988 491 | A1 | 11/2008 |
| EP | 1 988 601 | A1 | 11/2008 |
| EP | 1 993 170 | A1 | 11/2008 |
| EP | 2 009 738 | A1 | 12/2008 |
| EP | 2 012 258 | A1 | 1/2009 |
| EP | 2 096 709 | A1 | 9/2009 |
| EP | 2 148 449 | A1 | 1/2010 |
| EP | 2 251 934 | A1 | 11/2010 |
| GB | 2 305 075 | A | 3/1997 |
| GB | 2461443 | A | 1/2010 |
| JP | 50-143451 | A | 11/1975 |
| JP | 61-284102 | A | 12/1986 |
| JP | 62-127140 | U | 8/1987 |
| JP | 02-164105 | A | 6/1990 |
| JP | 02-256208 | A | 10/1990 |
| JP | 3-171385 | A | 7/1991 |
| JP | 03-503467 | A | 8/1991 |
| JP | 03-262313 | A | 11/1991 |
| JP | 04-150011 | A | 5/1992 |
| JP | 04-167500 | A | 6/1992 |
| JP | 04-096814 | U | 8/1992 |
| JP | 04-101168 | U | 9/1992 |
| JP | 04-134807 | U | 12/1992 |
| JP | 05-327331 | A | 12/1993 |
| JP | 6-53733 | A | 2/1994 |
| JP | 06-077729 | A | 3/1994 |
| JP | 06-177635 | A | 6/1994 |
| JP | 6-260949 | A | 9/1994 |
| JP | 07-183836 | A | 7/1995 |
| JP | 08-055725 | A | 2/1996 |
| JP | 08-056113 | A | 2/1996 |
| JP | 8-87580 | A | 4/1996 |
| JP | 08-88586 | A | 4/1996 |
| JP | 08-088586 | A | 4/1996 |
| JP | 08-176421 | A | 7/1996 |
| JP | 08-180160 | A | 7/1996 |
| JP | 08-279027 | A | 10/1996 |
| JP | 08-307126 | A | 11/1996 |
| JP | 08-330372 | A | 12/1996 |
| JP | 09-014150 | A | 1/1997 |
| JP | 09-035025 | A | 2/1997 |
| JP | 9-93029 | A | 4/1997 |
| JP | 09-093029 | A | 4/1997 |
| JP | 09-245381 | A | 9/1997 |
| JP | 09-252217 | A | 9/1997 |
| JP | 09-270623 | A | 10/1997 |
| JP | 09-284038 | A | 10/1997 |
| JP | 9-512367 | A | 12/1997 |
| JP | 10-069533 | A | 3/1998 |
| JP | 10-69533 | A | 3/1998 |
| JP | 10-505466 | A | 5/1998 |
| JP | 10-171954 | A | 6/1998 |
| JP | 10-173427 | A | 6/1998 |
| JP | 10-193849 | A | 7/1998 |
| JP | 10-193851 | A | 7/1998 |
| JP | 10-293828 | A | 11/1998 |
| JP | 10-334203 | A | 12/1998 |
| JP | 11-025244 | A | 1/1999 |
| JP | 11-039441 | A | 2/1999 |
| JP | 11-075329 | A | 3/1999 |
| JP | 11-085937 | A | 3/1999 |
| JP | 11-88241 | A | 3/1999 |
| JP | 11-102424 | A | 4/1999 |
| JP | 11-103209 | A | 4/1999 |
| JP | 11-149536 | A | 6/1999 |
| JP | 11-149537 | A | 6/1999 |
| JP | 11-149538 | A | 6/1999 |
| JP | 11-175678 | A | 7/1999 |
| JP | 11-219420 | A | 8/1999 |
| JP | 11-220319 | A | 8/1999 |
| JP | 11-282993 | A | 10/1999 |
| JP | 11-328352 | A | 11/1999 |
| JP | 11-331014 | A | 11/1999 |
| JP | 11-346114 | A | 12/1999 |
| JP | 11-515094 | A | 12/1999 |
| JP | 2000-21128 | A | 1/2000 |
| JP | 2000-021639 | A | 1/2000 |
| JP | 2000-022421 | A | 1/2000 |
| JP | 2000-059260 | A | 2/2000 |
| JP | 2000-085283 | A | 3/2000 |
| JP | 2000-090207 | A | 3/2000 |
| JP | 2000-132643 | A | 5/2000 |
| JP | 2000-137778 | A | 5/2000 |
| JP | 2000-137779 | A | 5/2000 |
| JP | 2000-137785 | A | 5/2000 |
| JP | 2000-148948 | A | 5/2000 |
| JP | 2000-172812 | A | 6/2000 |
| JP | 2000-209013 | A | 7/2000 |
| JP | 2000-222540 | A | 8/2000 |
| JP | 2000-510271 | A | 8/2000 |
| JP | 2000-242754 | A | 9/2000 |
| JP | 2000-243797 | A | 9/2000 |
| JP | 2000-251049 | A | 9/2000 |
| JP | 2000-261230 | A | 9/2000 |
| JP | 2000-276569 | A | 10/2000 |
| JP | 2000-286634 | A | 10/2000 |
| JP | 2000-286760 | A | 10/2000 |
| JP | 2000-311226 | A | 11/2000 |
| JP | 2000-321984 | A | 11/2000 |
| JP | 2000-349680 | A | 12/2000 |
| JP | 2001-10264 | A | 1/2001 |
| JP | 2001-028036 | A | 1/2001 |
| JP | 2001-043340 | A | 2/2001 |
| JP | 3075400 | U | 2/2001 |
| JP | 2001-66990 | A | 3/2001 |
| JP | 2001-76111 | A | 3/2001 |
| JP | 2001-084463 | A | 3/2001 |
| JP | 2001-101369 | A | 4/2001 |
| JP | 2001-505682 | A | 4/2001 |
| JP | 2001-168628 | A | 6/2001 |
| JP | 2001-188890 | A | 7/2001 |
| JP | 2001-240046 | A | 9/2001 |
| JP | 2001-240217 | A | 9/2001 |
| JP | 2001-256457 | A | 9/2001 |
| JP | 2001-257292 | A | 9/2001 |
| JP | 2001-514777 | A | 9/2001 |
| JP | 2001-319380 | A | 11/2001 |
| JP | 2001-331976 | A | 11/2001 |
| JP | 2001-332923 | A | 11/2001 |
| JP | 2001-339226 | A | 12/2001 |
| JP | 2001-344574 | A | 12/2001 |
| JP | 2001-351083 | A | 12/2001 |
| JP | 2001-351084 | A | 12/2001 |
| JP | 2001-352176 | A | 12/2001 |
| JP | 2001-358527 | A | 12/2001 |
| JP | 2002-024776 | A | 1/2002 |
| JP | 2002-026513 | A | 1/2002 |
| JP | 2002-32731 | A | 1/2002 |
| JP | 2002-042076 | A | 2/2002 |
| JP | 2002-063557 | A | 2/2002 |
| JP | 2002-505645 | A | 2/2002 |
| JP | 2002-76750 | A | 3/2002 |
| JP | 2002-076750 | A | 3/2002 |
| JP | 2002-111363 | A | 4/2002 |
| JP | 2002-150245 | A | 5/2002 |
| JP | 2002-157564 | A | 5/2002 |
| JP | 2002-158529 | A | 5/2002 |
| JP | 2002-175508 | A | 6/2002 |
| JP | 2002-183690 | A | 6/2002 |
| JP | 2002-185358 | A | 6/2002 |
| JP | 2002-204117 | A | 7/2002 |
| JP | 2002-522849 | A | 7/2002 |
| JP | 2002-230128 | A | 8/2002 |

(56) References Cited

FOREIGN PATENT DOCUMENTS

| | | | |
|---|---|---|---|
| JP | 2002-232221 | A | 8/2002 |
| JP | 2002-246828 | A | 8/2002 |
| JP | 2002-252117 | A | 9/2002 |
| JP | 2002-259934 | A | 9/2002 |
| JP | 2002-280821 | A | 9/2002 |
| JP | 2002-298109 | A | 10/2002 |
| JP | 2002-308437 | A | 10/2002 |
| JP | 2002-319008 | A | 10/2002 |
| JP | 2002-319009 | A | 10/2002 |
| JP | 2002-319812 | A | 10/2002 |
| JP | 2002-362613 | A | 12/2002 |
| JP | 2002-366917 | A | 12/2002 |
| JP | 2002-373029 | A | 12/2002 |
| JP | 2002-373323 | A | 12/2002 |
| JP | 2002-374139 | A | 12/2002 |
| JP | 2003-006599 | A | 1/2003 |
| JP | 2003-016412 | A | 1/2003 |
| JP | 2003-022912 | A | 1/2003 |
| JP | 2003-026177 | A | 1/2003 |
| JP | 2003-030612 | A | 1/2003 |
| JP | 2003-44789 | A | 2/2003 |
| JP | 2003-046318 | A | 2/2003 |
| JP | 2003-58840 | A | 2/2003 |
| JP | 2003-067711 | A | 3/2003 |
| JP | 2003-069335 | A | 3/2003 |
| JP | 2003-076947 | A | 3/2003 |
| JP | 2003-76963 | A | 3/2003 |
| JP | 2003-78333 | A | 3/2003 |
| JP | 2003-078336 | A | 3/2003 |
| JP | 2003-085501 | A | 3/2003 |
| JP | 2003-085520 | A | 3/2003 |
| JP | 2003-87008 | A | 3/2003 |
| JP | 2003-87044 | A | 3/2003 |
| JP | 2003-099184 | A | 4/2003 |
| JP | 2003-099720 | A | 4/2003 |
| JP | 2003-099721 | A | 4/2003 |
| JP | 2003-110344 | A | 4/2003 |
| JP | 2003-132330 | A | 5/2003 |
| JP | 2003-134007 | A | 5/2003 |
| JP | 2003-155062 | A | 5/2003 |
| JP | 2003-158414 | A | 5/2003 |
| JP | 2003-168760 | A | 6/2003 |
| JP | 2003-179565 | A | 6/2003 |
| JP | 2003-187207 | A | 7/2003 |
| JP | 2003-187211 | A | 7/2003 |
| JP | 2003-188338 | A | 7/2003 |
| JP | 2003-188620 | A | 7/2003 |
| JP | 2003-198230 | A | 7/2003 |
| JP | 2003-209421 | A | 7/2003 |
| JP | 2003-216919 | A | 7/2003 |
| JP | 2003-218624 | A | 7/2003 |
| JP | 2003-233780 | A | 8/2003 |
| JP | 2003-242471 | A | 8/2003 |
| JP | 2003-243918 | A | 8/2003 |
| JP | 2003-249813 | A | 9/2003 |
| JP | 2003-529163 | A | 9/2003 |
| JP | 2003-288560 | A | 10/2003 |
| JP | 2003-309418 | A | 10/2003 |
| JP | 2003-317060 | A | 11/2003 |
| JP | 2003-331246 | A | 11/2003 |
| JP | 2003-332820 | A | 11/2003 |
| JP | 2003-536302 | A | 12/2003 |
| JP | 2004-040597 | A | 2/2004 |
| JP | 2004-505481 | A | 2/2004 |
| JP | 2004-082775 | A | 3/2004 |
| JP | 2004-88218 | A | 3/2004 |
| JP | 2004-93693 | A | 3/2004 |
| JP | 2004-096566 | A | 3/2004 |
| JP | 2004-096618 | A | 3/2004 |
| JP | 2004-126750 | A | 4/2004 |
| JP | 2004-127230 | A | 4/2004 |
| JP | 2004-140513 | A | 5/2004 |
| JP | 2004-213582 | A | 7/2004 |
| JP | 2004-519916 | A | 7/2004 |
| JP | 2004-234595 | A | 8/2004 |
| JP | 2004-253858 | A | 9/2004 |
| JP | 2004-527864 | A | 9/2004 |
| JP | 2004-280390 | A | 10/2004 |
| JP | 2004-282403 | A | 10/2004 |
| JP | 2004-287767 | A | 10/2004 |
| JP | 2004-295297 | A | 10/2004 |
| JP | 2004-297249 | A | 10/2004 |
| JP | 2004-297681 | A | 10/2004 |
| JP | 2004-304370 | A | 10/2004 |
| JP | 2004-319848 | A | 11/2004 |
| JP | 2004-326380 | A | 11/2004 |
| JP | 2004-334268 | A | 11/2004 |
| JP | 2004-336250 | A | 11/2004 |
| JP | 2004-343000 | A | 12/2004 |
| JP | 2004-362190 | A | 12/2004 |
| JP | 2004-362341 | A | 12/2004 |
| JP | 2004-362602 | A | 12/2004 |
| JP | 2005-5866 | A | 1/2005 |
| JP | 2005-18156 | A | 1/2005 |
| JP | 2005-033461 | A | 2/2005 |
| JP | 2005-124061 | A | 5/2005 |
| JP | 2005-128592 | A | 5/2005 |
| JP | 2005-129019 | A | 5/2005 |
| JP | 2005-135132 | A | 5/2005 |
| JP | 2005-136528 | A | 5/2005 |
| JP | 2005-137032 | A | 5/2005 |
| JP | 3653099 | B2 | 5/2005 |
| JP | 2005-165839 | A | 6/2005 |
| JP | 2005-167327 | A | 6/2005 |
| JP | 2005-167813 | A | 6/2005 |
| JP | 2005-190417 | A | 7/2005 |
| JP | 2005-191705 | A | 7/2005 |
| JP | 2005-192124 | A | 7/2005 |
| JP | 2005-210676 | A | 8/2005 |
| JP | 2005-210680 | A | 8/2005 |
| JP | 2005-217822 | A | 8/2005 |
| JP | 2005-229474 | A | 8/2005 |
| JP | 2005-236339 | A | 9/2005 |
| JP | 2005-244778 | A | 9/2005 |
| JP | 2005-252853 | A | 9/2005 |
| JP | 2005-275870 | A | 10/2005 |
| JP | 2005-284352 | A | 10/2005 |
| JP | 2005-284455 | A | 10/2005 |
| JP | 2005-293537 | A | 10/2005 |
| JP | 2005-295135 | A | 10/2005 |
| JP | 2005-311205 | A | 11/2005 |
| JP | 2005-321305 | A | 11/2005 |
| JP | 2005-322119 | A | 11/2005 |
| JP | 2005-335755 | A | 12/2005 |
| JP | 2005-340759 | A | 12/2005 |
| JP | 2005-345802 | A | 12/2005 |
| JP | 2005-346820 | A | 12/2005 |
| JP | 2005-352858 | A | 12/2005 |
| JP | 2006-013976 | A | 1/2006 |
| JP | 2006-13976 | A | 1/2006 |
| JP | 2006-025390 | A | 1/2006 |
| JP | 2006-031766 | A | 2/2006 |
| JP | 2006-033312 | A | 2/2006 |
| JP | 2006-39902 | A | 2/2006 |
| JP | 2006-039947 | A | 2/2006 |
| JP | 2006-42059 | A | 2/2006 |
| JP | 2006-42097 | A | 2/2006 |
| JP | 2006-053833 | A | 2/2006 |
| JP | 2006-67479 | A | 3/2006 |
| JP | 2006-72706 | A | 3/2006 |
| JP | 2006-074348 | A | 3/2006 |
| JP | 2006-80367 | A | 3/2006 |
| JP | 2006-92630 | A | 4/2006 |
| JP | 2006-102953 | A | 4/2006 |
| JP | 2006-107296 | A | 4/2006 |
| JP | 2006-513594 | A | 4/2006 |
| JP | 2006-148462 | A | 6/2006 |
| JP | 2006-148518 | A | 6/2006 |
| JP | 2006-151402 | A | 6/2006 |
| JP | 2006-174151 | A | 6/2006 |
| JP | 2006-195795 | A | 7/2006 |
| JP | 2006-203187 | A | 8/2006 |
| JP | 2006-203852 | A | 8/2006 |
| JP | 2006-217000 | A | 8/2006 |

(56) References Cited

FOREIGN PATENT DOCUMENTS

| | | | |
|---|---|---|---|
| JP | 2006-232292 | A | 9/2006 |
| JP | 2006-237674 | A | 9/2006 |
| JP | 2006-246372 | A | 9/2006 |
| JP | 2006-270212 | A | 10/2006 |
| JP | 2006-270681 | A | 10/2006 |
| JP | 2006-270766 | A | 10/2006 |
| JP | 2006-285911 | A | 10/2006 |
| JP | 2006-287659 | A | 10/2006 |
| JP | 2006-295879 | A | 10/2006 |
| JP | 2006-302219 | A | 11/2006 |
| JP | 2006-309401 | A | 11/2006 |
| JP | 2006-311239 | A | 11/2006 |
| JP | 2006-323481 | A | 11/2006 |
| JP | 2006-339964 | A | 12/2006 |
| JP | 2007-007888 | A | 1/2007 |
| JP | 2007-13120 | A | 1/2007 |
| JP | 2007-18067 | A | 1/2007 |
| JP | 2007-019905 | A | 1/2007 |
| JP | 2007-28002 | A | 2/2007 |
| JP | 2007-043535 | A | 2/2007 |
| JP | 2007-048126 | A | 2/2007 |
| JP | 2007-65822 | A | 3/2007 |
| JP | 2007-79687 | A | 3/2007 |
| JP | 2007-81712 | A | 3/2007 |
| JP | 2007-096768 | A | 4/2007 |
| JP | 2007-102348 | A | 4/2007 |
| JP | 2007-116347 | A | 5/2007 |
| JP | 2007-122542 | A | 5/2007 |
| JP | 2007-150642 | A | 6/2007 |
| JP | 2007-150868 | A | 6/2007 |
| JP | 2007-159083 | A | 6/2007 |
| JP | 2007-159129 | A | 6/2007 |
| JP | 2007-166133 | A | 6/2007 |
| JP | 2007-172369 | A | 7/2007 |
| JP | 2007-172527 | A | 7/2007 |
| JP | 2007-228325 | A | 9/2007 |
| JP | 2007-233597 | A | 9/2007 |
| JP | 2007-266999 | A | 10/2007 |
| JP | 2007-272264 | A | 10/2007 |
| JP | 2007-287128 | A | 11/2007 |
| JP | 2007-295557 | A | 11/2007 |
| JP | 2007-312350 | A | 11/2007 |
| JP | 2007-324865 | A | 12/2007 |
| JP | 2008-033716 | A | 2/2008 |
| JP | 2008-042910 | A | 2/2008 |
| JP | 2008-72243 | A | 3/2008 |
| JP | 2008-083867 | A | 4/2008 |
| JP | 2008-097426 | A | 4/2008 |
| JP | 4069958 | B2 | 4/2008 |
| JP | 2008-103691 | A | 5/2008 |
| JP | 2008-107947 | A | 5/2008 |
| JP | 2008-148345 | A | 6/2008 |
| JP | 2008-519347 | A | 6/2008 |
| JP | 2008-160874 | A | 7/2008 |
| JP | 2008-167190 | A | 7/2008 |
| JP | 2008-197714 | A | 8/2008 |
| JP | 2008-535372 | A | 8/2008 |
| JP | 2008-207875 | A | 9/2008 |
| JP | 2008-217406 | A | 9/2008 |
| JP | 2008-288915 | A | 11/2008 |
| JP | 2009-017284 | A | 1/2009 |
| JP | 2009-25870 | A | 2/2009 |
| JP | 2009-27291 | A | 2/2009 |
| JP | 2009-044715 | A | 2/2009 |
| JP | 3148168 | U | 2/2009 |
| JP | 2009-110144 | A | 5/2009 |
| JP | 2009-182630 | A | 8/2009 |
| JP | 2010-009196 | A | 1/2010 |
| JP | 2010-081571 | | 4/2010 |
| JP | 4609604 | B2 | 1/2011 |
| NL | 9100176 | A | 3/1992 |
| NL | 9100347 | A | 3/1992 |
| WO | 98/33142 | A1 | 7/1998 |
| WO | 99/67754 | A1 | 12/1999 |
| WO | 00/10122 | A2 | 2/2000 |
| WO | 01/95242 | A2 | 12/2001 |
| WO | 02/48980 | A1 | 6/2002 |
| WO | 02/061675 | A1 | 8/2002 |
| WO | 02/097723 | A1 | 12/2002 |
| WO | 03/079305 | A1 | 9/2003 |
| WO | 2004/036772 | A2 | 4/2004 |
| WO | 2004/070879 | A | 8/2004 |
| WO | 2004/072892 | A2 | 8/2004 |
| WO | 2005/073937 | A | 8/2005 |
| WO | 2005/091434 | A1 | 9/2005 |
| WO | 2005/115849 | A1 | 12/2005 |
| WO | 2006/045682 | A | 5/2006 |
| WO | 2006/048663 | A1 | 5/2006 |
| WO | 2006/114821 | A1 | 11/2006 |
| WO | 2007/083574 | A1 | 7/2007 |
| WO | 2007/083575 | A1 | 7/2007 |
| WO | 2007/086130 | A1 | 8/2007 |
| WO | 2007/094494 | A1 | 8/2007 |
| WO | 2007/097385 | A1 | 8/2007 |
| WO | 2007/102360 | A1 | 9/2007 |
| WO | 2007/105348 | A1 | 9/2007 |
| WO | 2007/119310 | A1 | 10/2007 |
| WO | 2007/125683 | A1 | 11/2007 |
| WO | 2007/138857 | A1 | 12/2007 |
| WO | 2008/007606 | A | 1/2008 |
| WO | 2008/081699 | A1 | 7/2008 |
| WO | 2008/126458 | A1 | 10/2008 |
| WO | 2008/133018 | A1 | 11/2008 |
| WO | 2008/140037 | A1 | 11/2008 |
| WO | 2008/142957 | A1 | 11/2008 |
| WO | 2009/011144 | A1 | 1/2009 |
| WO | 2009/011376 | A1 | 1/2009 |
| WO | 2009/011400 | A1 | 1/2009 |
| WO | 2009/011423 | A1 | 1/2009 |
| WO | 2009/081719 | A1 | 7/2009 |
| WO | 2009/110381 | A1 | 9/2009 |
| WO | 2009/110382 | A1 | 9/2009 |

OTHER PUBLICATIONS

Kato: "Radio IC Device"; U.S. Appl. No. 13/080,775, filed Apr. 6, 2011.

Kato et al.: "Antenna and Wireless IC Device"; U.S. Appl. No. 13/083,626, filed Apr. 11, 2011.

Official Communication issued in International Patent Application No. PCT/JP2009/070617, mailed on Mar. 16, 2010.

Nagai, "Mounting Technique of RFID by Roll-To-Roll Process", Material Stage, Technical Information Institute Co., Ltd, vol. 7, No. 9, 2007, pp. 4-12.

Dokai et al.: "Wireless IC Device"; U.S. Appl. No. 13/088,480, filed Apr. 18, 2011.

Kato et al.: "High Frequency Device and Wireless IC Device"; U.S. Appl. No. 13/094,928, filed Apr. 27, 2011.

Dokai et al.: "Wireless IC Device"; U.S. Appl. No. 13/099,392, filed May 3, 2011.

Kato et al.: "Radio Frequency IC Device"; U.S. Appl. No. 13/163,803, filed Jun. 20, 2011.

Official Communication issued in International Patent Application No. PCT/JP2010/050170, mailed on Apr. 13, 2010.

Official Communication issued in International Patent Application No. PCT/JP2010/051205, mailed on May 11, 2010.

Kato: "Wireless IC Device, Wireless IC Module and Method of Manufacturing Wireless IC Module"; U.S. Appl. No. 13/169,067, filed Jun. 27, 2011.

Kato et al.: "Antenna and Wireless IC Device"; U.S. Appl. No. 13/190,670, filed Jul. 26, 2011.

Shiroki et al.: "RFIC Chip Mounting Structure"; U.S. Appl. No. 13/223,429, filed Sep. 1, 2011.

Official Communication issued in International Patent Application No. PCT/JP2010/056559, mailed on Jul. 27, 2010.

Taniguchi et al.: "Antenna Device and Radio Frequency IC Device"; U.S. Appl. No. 13/232,102, filed Sep. 14, 2011.

Official Communication issued in International Patent Application No. PCT/JP2010/053496, mailed on Jun. 1, 2010.

Ikemoto: "Wireless IC Tag, Reader-Writer, and Information Processing System"; U.S. Appl. No. 13/329,354, filed Dec. 19, 2011.

(56) References Cited

OTHER PUBLICATIONS

Kato et al.: "Antenna and Antenna Module"; U.S. Appl. No. 13/334,462, filed Dec. 22, 2011.
Official Communication issued in International Patent Application No. PCT/JP2010/069418, mailed on Feb. 8, 2011.
Official Communication issued in International Patent Application No. PCT/JP2010/063082, mailed on Nov. 16, 2010.
Ikemoto: "Communication Terminal and Information Processing System"; U.S. Appl. No. 13/412,772, filed Mar. 6, 2012.
"Antenna Engineering Handbook", The Institute of Electronics and Communication Engineers, Mar. 5, 1999, pp. 20-21.
Official Communication issued in International Patent Application No. PCT/JP2009/066336, mailed on Dec. 22, 2009.
Official Communication issued in corresponding Japanese Patent Application No. 2010-509439, mailed on Jul. 6, 2010.
Official Communication issued in corresponding Japanese Patent Application No. 2011-032311, mailed on Mar. 29, 2011.
Official Communication issued in corresponding Japanese Patent Application No. 2009-525327, drafted on Sep. 22, 2010.
Official Communication issued in corresponding Japanese Patent Application No. 2011-032311, mailed on Aug. 2, 2011.
Official Communication issued in corresponding Japanese Patent Application No. 2011-032312, mailed on Aug. 2, 2011.
Official Communication issued in corresponding Japanese Patent Application No. 2011-032311, mailed on Aug. 23, 2011.
Kato et al.: "Wireless IC Device Component and Wireless IC Device"; U.S. Appl. No. 13/241,823, filed Sep. 23, 2011.
Kato et al.: "Antenna Device and Method of Setting Resonant Frequency of Antenna Device"; U.S. Appl. No. 13/272,365, on Oct. 13, 2011.
Official Communication issued in International Patent Application No. PCT/JP2010/056812, mailed on Jul. 13, 2010.
Doaki et al.: "Optical Disc"; U.S. Appl. No. 13/295,153, filed Nov. 14, 2011.
Official Communication issued in International Patent Application No. PCT/JP2010/057668, mailed on Aug. 17, 2010.
Osamura et al.: "Radio Frequency IC Device and Method of Manufacturing the Same"; U.S. Appl. No. 13/308,575, filed Dec. 1, 2011.
Official Communication issued in International Patent Application No. PCT/JP2010/069417, mailed on Dec. 7, 2010.
Kato: "Wireless IC Device and Coupling Method for Power Feeding Circuit and Radiation Plate"; U.S. Appl. No. 13/325,273, filed Dec. 14, 2011.
Official communication issued in counterpart International Application No. PCT/JP2008/071502, mailed Feb. 24, 2009.
Kato et al.: "Wireless IC Device and Manufacturing Method Thereof," U.S. Appl. No. 12/432,854, filed Apr. 30, 2009.
Official communication issued in counterpart International Application No. PCT/JP2008/058168, mailed Aug. 12, 2008.
Official communication issued in counterpart International Application No. PCT/JP2008/062886, mailed Oct. 21, 2008.
Kato et al.: "Wireless IC Device," U.S. Appl. No. 12/469,896, filed May 21, 2009.
Ikemoto et al.: "Wireless IC Device," U.S. Appl. No. 12/496,709, filed Jul. 2, 2009.
Official communication issued in counterpart International Application No. PCT/JP2008/062947, mailed Aug. 19, 2008.
Official communication issued in counterpart International Application No. PCT/JP2008/056026, mailed Jul. 1, 2008.
Ikemoto et al.: "Wireless IC Device and Electronic Apparatus," U.S. Appl. No. 12/503,188, filed Jul. 15, 2009.
Official communication issued in counterpart International Application No. PCT/JP2008/055567, mailed May 20, 2008.
Official communication issued in counterpart International Application No. PCT/JP2008/051853, mailed Apr. 22, 2008.
Official communication issued in counterpart International Application No. PCT/JP2008/057239, mailed Jul. 22, 2008.
Kimura et al.: "Wireless IC Device," U.S. Appl. No. 12/510,338, filed Jul. 28, 2009.
Kato et al.: "Wireless IC Device," U.S. Appl. No. 12/510,340, filed Jul. 28, 2009.
Kato: "Wireless IC Device," U.S. Appl. No. 12/510,344, filed Jul. 28, 2009.
Kato et al.: "Wireless IC Device," U.S. Appl. No. 12/510,347, filed Jul. 28, 2009.
Official Communication issued in International Patent Application No. PCT/JP2009/056934, mailed on Jun. 30, 2009.
Kato et al.: "Wireless IC Device"; U.S. Appl. No. 12/903,242, filed Oct. 13, 2010.
Kato et al.: "Wireless IC Device"; U.S. Appl. No. 12/940,103, filed Nov. 5, 2010.
Kato et al.: "Wireless IC Device System and Method of Determining Authenticity of Wireless IC Device"; U.S. Appl. No. 12/940,105, filed Nov. 5, 2010.
Official Communication issued in International Patent Application No. PCT/JP2009/059669, mailed on Aug. 25, 2009.
Official Communication issued in International Patent Application No. PCT/JP2009/062181, mailed on Oct. 13, 2009.
Official Communication issued in corresponding Japanese Application No. 2010-501323, mailed on Apr. 6, 2010.
Kato et al.: "Component of Wireless IC Device and Wireless IC Device"; U.S. Appl. No. 12/944,099, filed Nov. 11, 2010.
Kato et al.: Wireless IC Device and Manufacturing Method Thereof; U.S. Appl. No. 12/961,599, filed Dec. 7, 2010.
Kataya et al.: "Radio Frequency IC Device and Electronic Apparatus"; U.S. Appl. No. 12/959,454, filed Dec. 3, 2010.
Ikemoto et al.:"Radio IC Device"; U.S. Appl. No. 12/981,582, filed Dec. 30, 2010.
Official Communication issued in International Patent Application No. PCT/JP2009/062801, mailed on Oct. 27, 2009.
Ikemoto et al.: "Wireless IC Device and Electronic Apparatus"; U.S. Appl. No. 13/022,695, filed Feb. 8, 2011.
Official Communication issued in International Patent Application No. PCT/JP2009/067778, mailed on Jan. 26, 2010.
Kato: "Wireless IC Device and Method for Manufacturing Same"; U.S. Appl. No. 13/022,693, filed Feb. 8, 2011.
Kato: "Wireless IC Device"; U.S. Appl. No. 13/080,781, filed Apr. 6, 2011.
Official Communication issued in International Patent Application No. PCT/JP2008/063025, mailed on Aug. 12, 2008.
Kato et al.: "Wireless IC Device," U.S. Appl. No. 12/603,608, filed Oct. 22, 2009.
Kato et al.: "Wireless IC Device," U.S. Appl. No. 12/688,072, filed Jan. 15, 2010.
Official Communication issued in International Patent Application No. PCT/JP2009/053693, mailed on Jun. 9, 2009.
Kato: "Composite Antenna," U.S. Appl. No. 12/845,846, filed Jul. 29, 2010.
Official Communication issued in International Patent Application No. PCT/JP2009/053690, mailed on Jun. 2, 2009.
Kato et al.: "Radio Frequency IC Device and Radio Communication System," U.S. Appl. No. 12/859,340, filed Aug. 19, 2010.
Official Communication issued in International Patent Application No. PCT/JP2009/055758, mailed on Jun. 23, 2009.
Kato et al.: "Wireless IC Device," U.S. Appl. No. 12/859,880, filed Aug. 20, 2010.
Official Communication issued in International Patent Application No. PCT/JP2009/057482, mailed on Jul. 21, 2009.
Kataya et al.: "Wireless IC Device, Electronic Apparatus, and Method for Adjusting Resonant Frequency of Wireless IC Device," U.S. Appl. No. 12/861,945, filed Aug. 24, 2010.
Kato: "Wireless IC Device and Electromagnetic Coupling Module," U.S. Appl. No. 12/890,895, filed Sep. 27, 2010.
Official Communication issued in International Patent Application No. PCT/JP2009/059410, mailed on Aug. 4, 2009.
Kato et al.: "Wireless IC Device" U.S. Appl. No. 12/902,174, filed Oct. 12, 2010.
Official Communication issued in International Patent Application No. PCT/JP2009/059259, mailed on Aug. 11, 2009.
Official Communication issued in corresponding Japanese Patent Application No. 2010-506742, mailed on Apr. 6, 2010.

(56) References Cited

OTHER PUBLICATIONS

Official Communication issued in International Patent Application No. PCT/JP2009/056698, mailed on Jul. 7, 2009.
Official Communication issued in International Application No. PCT/JP2007/066007, mailed on Nov. 27, 2007.
Dokai et al.: "Wireless IC Device and Component for Wireless IC Device"; U.S. Appl. No. 12/359,690, filed Jan. 26, 2009.
Dokai et al.: "Test System for Radio Frequency IC Devices and Method of Manufacturing Radio Frequency IC Device Using the Same"; U.S. Appl. No. 12/388, 826, filed Feb. 19, 2009.
Official Communication issued in International Application No. PCT/JP2008/061955, mailed on Sep. 30, 2008.
Official Communication issued in International Application No. PCT/JP2007/066721, mailed on Nov. 27, 2007.
Official Communication issued in International Application No. PCT/JP2007/070460, mailed on Dec. 11, 2007.
Kato et al.: "Wireless IC Device"; U.S. Appl. No. 12/390,556, filed Feb. 23, 2009.
Kato et al.: "Inductively Coupled Module and Item With Inductively Coupled Module"; U.S. Appl. No. 12/398,497, filed Mar. 5, 2009.
Official Communication issued in International Patent Application No. PCT/JP2008/050945, mailed on May 1, 2008.
Kato et al.: "Article Having Electromagnetic Coupling Module Attached Thereto"; U.S. Appl. No. 12/401,767, filed Mar. 11, 2009.
Taniguchi et al.: "Antenna Device and Radio Frequency IC Device"; U.S. Appl. No. 12/326,117, filed Dec. 2, 2008.
Official Communication issued in International Patent Application No. PCT/JP2008/061442, mailed on Jul. 22, 2008.
Kato et al.: "Container With Electromagnetic Coupling Module"; U.S. Appl. No. 12/426,369, filed Apr. 20, 2009.
Kato: "Wireless IC Device"; U.S. Appl. No. 12/429,346, filed Apr. 24, 2009.
Official communication issued in counterpart European Application No. 08 77 7758, dated on Jun. 30, 2009.
Official communication issued in counterpart Japanese Application No. 2008-103741, mailed on May 26, 2009.
Official communication issued in counterpart Japanese Application No. 2008-103742, mailed on May 26, 2009.
Official communication issued in International Application No. PCT/JP2008/050358, mailed on Mar. 25, 2008.
Official communication issued in International Application No. PCT/JP2008/050356, mailed on Mar. 25, 2008.
Osamura et al.: "Packaging Material With Electromagnetic Coupling Module," U.S. Appl. No. 12/536,669, filed Aug. 6, 2009.
Dokai et al.: "Wireless IC Device and Component for Wireless IC Device," U.S. Appl. No. 12/543,553, filed Aug. 19, 2009.
Shioya et al.: "Wireless IC Device," U.S. Appl. No. 12/551,037, filed Aug. 31, 2009.
Ikemoto: "Wireless IC Device and Manufacturing Method Thereof," U.S. Appl. No. 12/579,672, filed Oct. 15, 2009.
Official communication issued in International Application No. PCT/JP2008/058614, mailed on Jun. 10, 2008.
English translation of NL9100176, published on Mar. 2, 1992.
English translation of NL9100347, published on Mar. 2, 1992.
Kato et al.: "Antenna"; U.S. Appl. No. 11/928,502, filed Oct. 30, 2007.
Kato et al.: "Wireless IC Device"; U.S. Appl. No. 12/211,117, filed Sep. 16, 2008.
Kato et al.: "Antenna"; U.S. Appl. No. 11/688,290, filed Mar. 20, 2007.
Kato et al.: "Electromagnetic-Coupling-Module-Attached Article"; U.S. Appl. No. 11/740,509, filed Apr. 26, 2007.
Kato et al.: "Product Including Power Supply Circuit Board"; U.S. Appl. No. 12/234,949, filed Sep. 22, 2008.
Kato et al.: "Data Coupler"; U.S. Appl. No. 12/252,475, filed Oct. 16, 2008.
Kato et al.; "Information Terminal Device"; U.S. Appl. No. 12/267,666, filed Nov. 10, 2008.
Kato et al.: "Wireless IC Device and Wireless IC Device Composite Component"; U.S. Appl. No. 12/276,444, filed Nov. 24, 2008.
Dokai et al.: "Optical Disc"; U.S. Appl. No. 12/326,916, filed Dec. 3, 2008.
Dokai et al.: "System for Inspecting Electromagnetic Coupling Modules and Radio IC Devices and Method for Manufacturing Electromagnetic Coupling Modules and Radio IC Devices Using the System"; U.S. Appl. No. 12/274,400, filed Nov. 20, 2008.
Kato: "Wireless IC Device"; U.S. Appl. No. 11/964,185, filed Dec. 26, 2007.
Kato et al.: "Radio Frequency IC Device"; U.S. Appl. No. 12/336,629, filed Dec. 17, 2008.
Kato et al.: "Wireless IC Device and Component for Wireless IC Device"; U.S. Appl. No. 12/339,198, filed Dec. 19, 2008.
Ikemoto et al.: "Wireless IC Device"; U.S. Appl. No. 11/851,651, filed Sep. 7, 2007.
Kataya et al.: "Wireless IC Device and Electronic Device"; U.S. Appl. No. 11/851,661, filed Sep. 7, 2007.
Dokai et al.: "Antenna and Radio IC Device"; U.S. Appl. No. 12/350,307, filed Jan. 8, 2009.
Official communication issued in Japanese Application No. 2007-531524, mailed on Sep. 11, 2007.
Official communication issued in Japanese Application No. 2007-531525, mailed on Sep. 25, 2007.
Official communication issued in Japanese Application No. 2007-531524, mailed on Dec. 12, 2007.
Official communication issued in European Application No. 07706650.4, mailed on Nov. 24, 2008.
Mukku-Sha, "Musen IC Tagu Katsuyo-no Subete" "(All About Wireless IC Tags"), RFID, pp. 112-126.
Dokai et al.: "Wireless IC Device and Component for Wireless IC Device"; U.S. Appl. No. 11/624,382, filed Jan. 18, 2007.
Dokai et al.: "Wireless IC Device, and Component for Wireless IC Device"; U.S. Appl. No. 11/930,818, filed Oct. 31, 2007.
Kato et al.: "Wireless IC Device"; U.S. Appl. No. 12/042,399, filed Mar. 5, 2008.
Official communication issued in related U.S. Appl. No. 12/042,399; mailed on Aug. 25, 2008.

* cited by examiner

ANTENNA AND WIRELESS IC DEVICE

BACKGROUND OF THE INVENTION

1. Field of the Invention

The present invention relates to an antenna and a wireless IC device. Specifically, the present invention relates to a loop-shaped antenna and a wireless IC device equipped therewith.

2. Description of the Related Art

As the structure of an antenna provided in a wireless tag, a loop antenna is known. In general, the loop antenna is configured using an electrode (conductor) formed in a loop shape beginning at a feeding point. A loop antenna is disclosed in "Antenna Engineering Handbook", written and edited by The Institute of Electronics and Communication Engineers, published by Ohmsha, Ltd., Mar. 5, 1999, P. 20 to P. 22.

However, since, in general, the loop antenna has an impedance whose real portion is small, there has been a problem that it is hard to achieve impedance matching with a wireless IC and a gain is easily deteriorated. Namely, while the real portion of the impedance of the wireless IC is within the range of 10Ω to 20Ω, for example, the real portion of the impedance of the loop antenna is as low as 5Ω, for example.

The above-mentioned problem is especially noticeable in a UHF frequency band, and the problem grows bigger in a wireless tag utilizing a UHF band.

SUMMARY OF THE INVENTION

Therefore, preferred embodiments of the present invention to provide an antenna causing impedance matching with a wireless IC to be easily achieved and preventing the deterioration of a gain and the wireless IC device including the antenna.

An antenna according to a preferred embodiment of the present invention includes a loop electrode including two feeding points and having a loop shape, and an auxiliary electrode configured to be electrically connected to the loop electrode and located at a position along the loop electrode.

The auxiliary electrode is electrically connected to the loop electrode, for example, in the vicinity of the feeding point of the loop electrode.

The auxiliary electrode is located at a position along an outer circumference of the loop electrode, for example.

The auxiliary electrode extends in a same direction as the loop electrode in relation to the feeding point, for example.

For example, the auxiliary electrode is single and connected to the vicinity of one feeding point of the two feeding points.

For example, the auxiliary electrode includes two auxiliary electrodes whose lengths different from each other.

The auxiliary electrode includes a shape of a meander pattern in at least a portion, for example.

A resonance frequency of a circuit based on the loop electrode and the auxiliary electrode is deviated from a communication frequency, for example.

A resonance frequency of a circuit based on the loop electrode and the auxiliary electrode is a frequency of a UHF band.

The communication frequency is a UHF band, for example, and the resonance frequency of the circuit based on the loop electrode and the auxiliary electrode is deviated to a frequency of about 30 MHz or more lower than the communication frequency, for example.

A wireless IC according to another preferred embodiment of the present invention includes the antenna according to any one of the above-mentioned configurations, and the wireless IC device includes a wireless IC configured to perform power feeding on a feeding point of the antenna.

The wireless IC may include, for example, a feed circuit arranged to perform power feeding on (connected to) the feeding point of the antenna and an IC chip arranged to perform power feeding on the feeding point of the antenna through the feed circuit.

The feed circuit includes a resonant circuit whose resonance frequency substantially corresponds to the communication frequency, for example.

The feed circuit is configured, for example, in a feed circuit substrate and the IC chip may be mounted in the feed circuit substrate.

According to various preferred embodiments of the present invention, since the auxiliary electrode is electrically connected to the loop electrode and located at a position along the loop electrode, the real portion of an impedance is large compared with a loop antenna based on a simple loop electrode. Therefore, it is easy to achieve impedance matching with the wireless IC, and it is possible to improve an antenna gain.

In addition, the auxiliary electrode is located at a position along the loop electrode, and hence the radiation characteristic of the antenna is not negatively affected.

For example, the auxiliary electrode is disposed so as to follow the loop-shaped electrode from the vicinity of one feeding point of the loop electrode, and hence parallel resonance occurs due to a capacitance occurring between the loop electrode and the auxiliary electrode and the individual inductances thereof. In addition, because of this parallel resonance, it is possible to enlarge the real portion of an impedance in the vicinity of a resonance frequency. Therefore, it is easy to achieve matching with the wireless IC, and the antenna gain is improved.

Since, in the vicinity of the resonance (the above-mentioned parallel resonance) frequency of a circuit based on the loop electrode and the auxiliary electrode, currents flowing in the loop electrode and the auxiliary electrode are opposite to each other in phase, the antenna gain is deteriorated. Therefore, by deviating the above-mentioned resonance frequency from a frequency used in communication, it is possible to reduce the influence of the antenna gain deterioration.

An electrode is arranged so that the auxiliary electrode follows the outer side of the loop electrode, and hence it is possible to enlarge capacitance between electrodes, and it is possible to reduce an influence on an antenna directivity.

In addition, in particular, the auxiliary electrode is preferably disposed so as to follow the outer side of the loop electrode, and hence the auxiliary electrode does not interfere with the path of a magnetic flux. Therefore, the antenna gain becomes larger.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 7-1A through 7-1H are diagrams illustrating an electrode pattern of each layer in a feed circuit substrate 40.

FIG. 7-2 is an equivalent circuit diagram based on the feed circuit substrate 40 and a feed circuit.

DETAILED DESCRIPTION OF THE PREFERRED EMBODIMENTS

First Preferred Embodiment

Figure 1A:
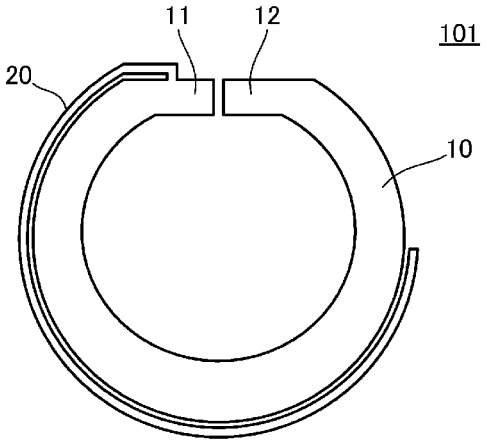
FIG. 1A is a plan view of an antenna 101 according to a first preferred embodiment.
Figure 1B:
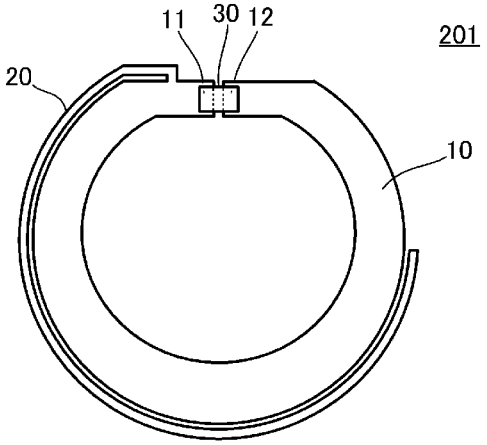
FIG. 1B is a plan view of a wireless IC device 201 including the antenna 101.

FIG. 1A is a plan view of an antenna 101 according to a first preferred embodiment, and FIG. 1B is a plan view of a wireless IC device 201 including the antenna 101.

The antenna 101 includes two feeding points 11 and 12, and includes a loop electrode 10 whose starting point and ending point are the feeding points 11 and 12, respectively, and that is arranged in a loop shape, and an auxiliary electrode 20 electrically connected to the loop electrode 10 and located at a position along the outer circumference of the loop electrode 10. The loop electrode 10 defines as a main radiation element.

The loop electrode 10 and the auxiliary electrode 20 preferably are copper foils patterned on a substrate, for example. The vicinities of both end portions of the loop electrode 10 are regarded as the feeding points 11 and 12. The first end portion of the auxiliary electrode 20 is electrically connected to the vicinity of one feeding point 11 of the loop electrode 10, and the auxiliary electrode 20 extends therefrom with respect to the loop electrode 10 in a same direction as and in parallel with the loop electrode 10. In addition, the second end portion of the auxiliary electrode 20 is open.

As described hereinafter, by providing the auxiliary electrode 20, it is possible to enhance the impedance (real portion) of the antenna, compared with a case in which the antenna (loop antenna) is configured using the simple loop electrode 10, and it is easy to achieve impedance matching with the wireless IC.

In addition, the auxiliary electrode is located at a position along the loop electrode, namely, the auxiliary electrode is arranged in parallel to the loop electrode, and hence, when the loop electrode operates as a magnetic field antenna, the radiation characteristic of the antenna is not negatively affected. In addition, since the width of the auxiliary electrode is thinner than the width of the loop electrode, an area necessary for pattern formation increases very little.

As illustrated in FIG. 1B, a wireless IC 30 is mounted in the feeding points 11 and 12 of the loop electrode 10, and hence, the wireless IC device 201 is configured.

The wireless IC 30 includes a memory circuit and a logic circuit, is conductively connected to the feeding points 11 and 12 of the loop electrode 10, and, using the antenna 101 based on the loop electrode 10 and the auxiliary electrode 20, causes the wireless IC device 201 to function as a wireless tag.

Figure 2A:
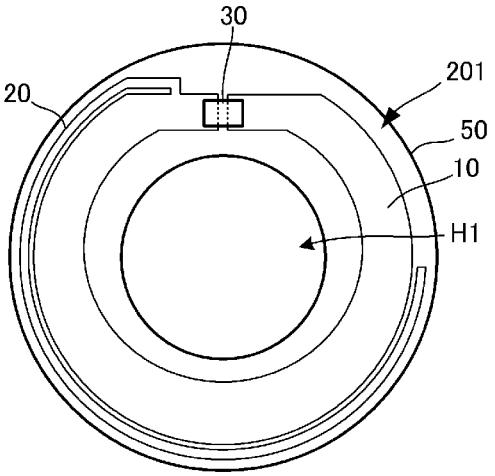
FIG. 2A is a plan view of a substrate in which the wireless IC device 201 illustrated in FIGS. 1A and 1B is configured.
Figure 2B:
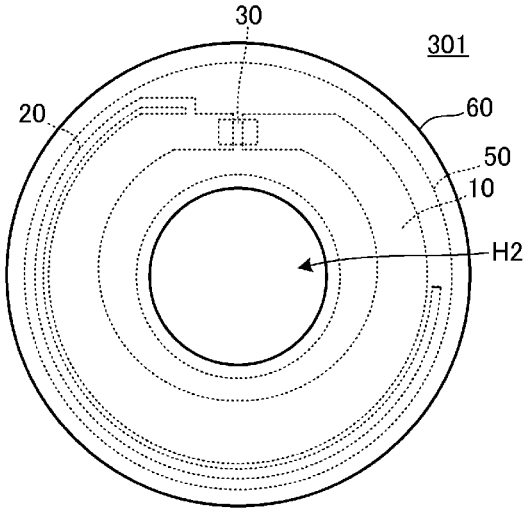
FIG. 2B is a plan view of a wireless tag 301.
Figure 2C:
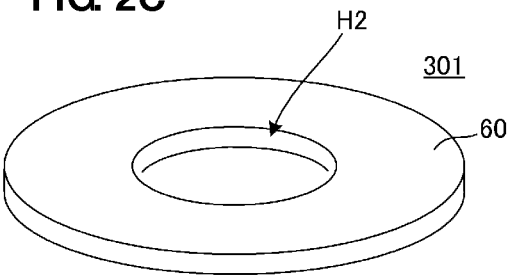
FIG. 2C is a perspective view of the wireless tag 301.

FIG. 2A is the plan view of a substrate in which the wireless IC device 201 illustrated in FIGS. 1A and 1B is configured, FIG. 2B is the plan view of a wireless tag 301, and FIG. 2C is the perspective view of the wireless tag 301.

As illustrated in FIG. 2A, the wireless IC device 201 illustrated in FIGS. 1A and 1B is configured in a disk-shaped (doughnut-disk-shaped) substrate 50 including a hole H1 in the central portion thereof.

As illustrated in FIG. 2B and FIG. 2C, the wireless tag 301 is configured preferably by molding the substrate illustrated in FIG. 2A using a mold resin 60. A hole H2 is formed in the central portion of the mold resin 60. The hole H2 is used for being attached to an article to be managed using the wireless tag.

Figure 3:
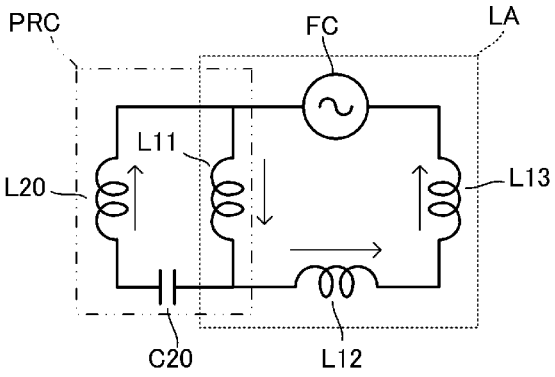
FIG. 3 is an equivalent circuit diagram of the wireless IC device 201.

FIG. 3 is the equivalent circuit diagram of the wireless IC device 201. Here, the loop electrode 10 is expressed by a lumped constant circuit based on three inductors L11, L12, and L13. A feed circuit FC is to be connected to this loop electrode. A loop antenna LA is configured to include the three inductors L11, L12, and L13. The auxiliary electrode 20 is expressed by an inductor L20. The above-mentioned inductor L11 is an inductor due to inductive coupling between the loop electrode 10 and the auxiliary electrode 20. Furthermore, capacitance occurring between the loop electrode 10 and the auxiliary electrode 20 is expressed by a capacitor C20. By providing to the inductors L11 and L20 and the capacitor C20, a parallel resonance circuit PRC is configured. In this regard, however, since a circuit that is fundamentally a distributed constant circuit is converted into the lumped constant circuit and expressed, the lumped constant circuit is not necessarily an accurate equivalent circuit, and corresponds to an image diagram or a simplified diagram.

This equivalent circuit may be viewed as a circuit where a resonator parallel-resonating with the loop electrode is added to the loop electrode, thereby causing impedance matching to be achieved. Since, at the resonance frequency of the above-mentioned resonant circuit, a relationship is built in which a current flowing in the loop electrode 10 and a current flowing in the auxiliary electrode 20 are opposite to each other in phase, an antenna gain is lowered. Therefore, it is desirable that the resonance frequency of the resonator including the L20 and the C20 is set to a frequency lower than a communication frequency used in the wireless tag.

Figure 4A:
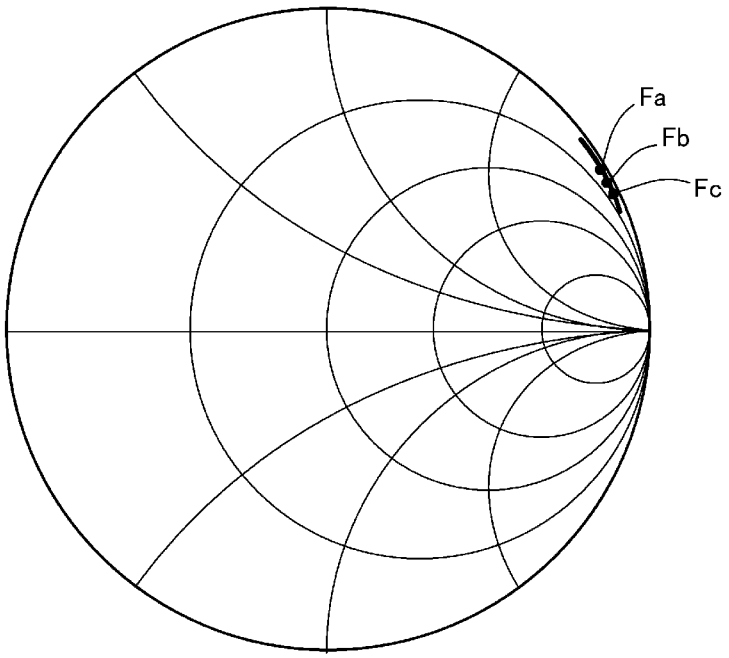
FIG. 4A is a diagram in which an impedance in a predetermined frequency range is expressed on a Smith chart when an auxiliary electrode 20 in the antenna 101 illustrated in FIGS. 1A and 1B is not provided.
Figure 4B:
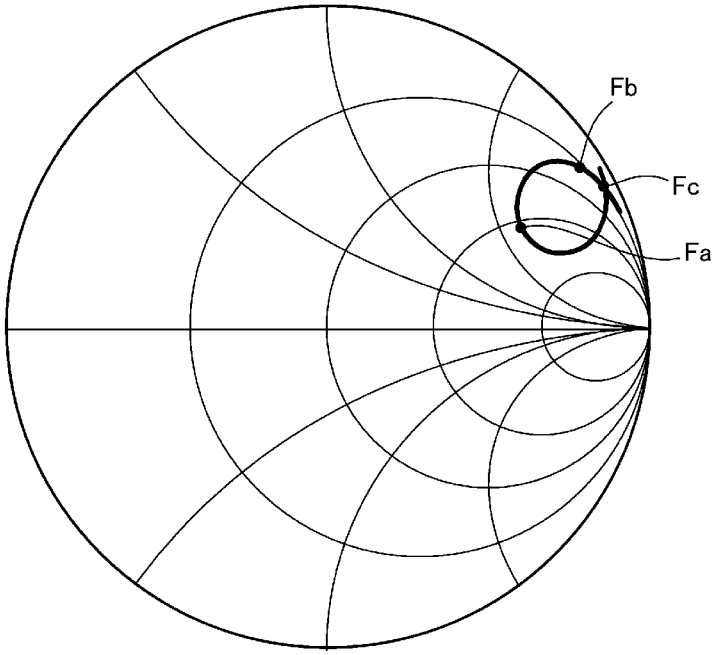
FIG. 4B is a diagram in which an impedance in a predetermined frequency range of the antenna 101 illustrated in FIGS. 1A and 1B is expressed on a Smith chart.

FIG. 4A is a diagram in which an impedance in a predetermined frequency range is expressed on a Smith chart when the auxiliary electrode 20 in the antenna 101 illustrated in FIGS. 1A and 1B is not provided. FIG. 4B is a diagram in which an impedance in a predetermined frequency range in the antenna 101 illustrated in FIGS. 1A and 1B is expressed on a Smith chart.

Here, a case of being applied to a UHF frequency band will be illustrated.

In FIG. 4A and FIG. 4B, points Fa, Fb, and Fc on the Smith chart indicate impedances at frequencies corresponding to frequencies of, for example, 860 MHz, 915 MHz, and 960 MHz, respectively.

In such a way, providing the auxiliary electrode 20 results in adding the parallel resonance circuit PRC illustrated in FIG. 3, and, at the resonance frequency thereof, an impedance viewed from the feeding points 11 and 12 becomes large. Here, the resonance frequency of the parallel resonance circuit PRC is preferably set to 860 MHz, for example.

When the auxiliary electrode 20 does not exist, the real portion of an impedance at each frequency is as follows.

| Frequency [MHz] | Impedance [Ω] |
|---|---|
| 860 | 2.9 |
| 915 | 5.2 |
| 960 | 5.7 |

In addition, the real portion of an impedance at each frequency of the antenna 101 including the auxiliary electrode 20 is as follows.

| Frequency [MHz] | Impedance [Ω] |
|---|---|
| 860 | 100.8 |
| 915 | 16.7 |
| 960 | 10.5 |

In this way, when the electrical length of the loop electrode is less than or equal to the half wavelength of an operation frequency (about 16 cm at the frequency of 900 MHz), in a case in which no auxiliary electrode is provided (in a case of a single loop electrode), while the impedance of the antenna is as low as several Ω, the impedance of the antenna becomes greater than or equal to a little more than about 10Ω as a result of providing the auxiliary electrode 20. Therefore, it is possible to achieve impedance matching with the wireless IC whose impedance viewed from an input and output terminal is generally as large as about 10Ω to about 20Ω, for example.

Figure 5A:
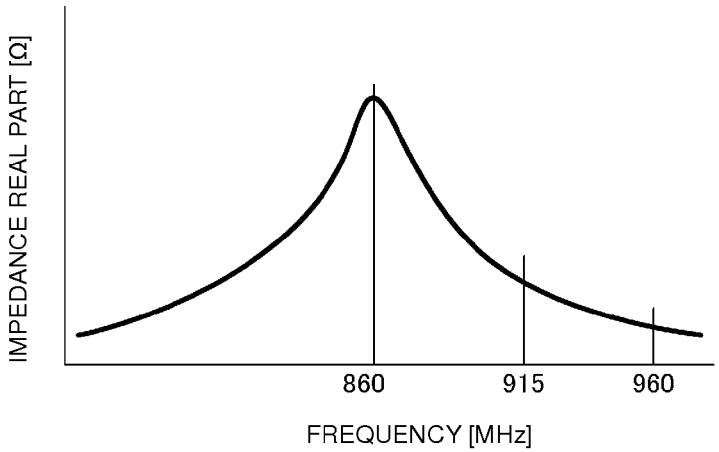
FIG. 5A is a diagram illustrating a frequency characteristic of a real portion impedance of the antenna 101 illustrated in FIGS. 1A and 1B.
Figure 5B:
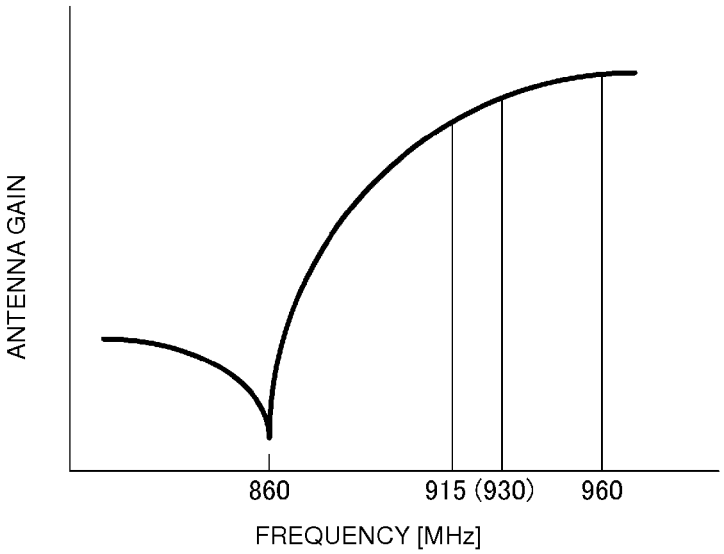
FIG. 5B is a diagram illustrating a frequency characteristic of an antenna gain of the antenna 101 illustrated in FIGS. 1A and 1B.

FIG. 5A is a diagram illustrating the frequency characteristic of the real portion of the impedance of the antenna. FIG. 5B is a diagram illustrating the frequency characteristic of an antenna gain.

As described above, in this example, since the resonance frequency of the parallel resonance circuit is preferably set to about 860 MHz, the impedance is maximized at the frequency of about 860 MHz, and the impedance becomes smaller even if the frequency is higher or lower than the frequency of about 860 MHz.

On the other hand, since, at about 860 MHz of the resonance frequency, currents flowing in the inductors L11 and L20 illustrated in FIG. 3 are opposite to each other in phase, the antenna gain is minimized at about 860 MHz as illustrated in FIG. 5B. The antenna gain becomes large even if the frequency is higher or lower than the frequency of about 860 MHz. Accordingly, by deviating the resonance frequency of the above-mentioned resonant circuit from a communication frequency, it is possible to obtain a predetermined antenna gain at the communication frequency. In this example, a frequency of about 915 MHz or about 960 MHz is available.

In addition, as for the above-mentioned resonant circuit, the reactance of the circuit has an induction property (inductance) at a frequency less than or equal to the resonance frequency, and a capacitive property (capacitance) at a frequency greater than or equal to the resonance frequency. In addition, since the capacitive property has a lower loss than the induction property, the antenna gain becomes large at a frequency greater than or equal to the resonance frequency at which the reactance of the circuit has the capacitive property. Therefore, it is better for the resonance frequency of the above-mentioned resonant circuit to be set so as not to be deviated to a higher frequency than the communication frequency but to be deviated to a lower frequency than the communication frequency.

In particular, in the UHF band, it is desirable that the resonance frequency of the resonant circuit is deviated to a frequency of about 30 MHz or more lower than a communication frequency band. In this example, the communication frequency band is about 960 MHz, and the resonance frequency of the above-mentioned resonant circuit is set to a frequency less than or equal to 960 MHz−30 MHz=930 MHz, for example.

As for the resonance frequency of the above-mentioned resonant circuit, it is only necessary to define the shape, the dimension, and the positional relationship with respect to the loop electrode 10 of the auxiliary electrode 20. For example, it is possible to define inductance on the basis of the length of the auxiliary electrode 20, and it is possible to define capacitance on the basis of a gap with the loop electrode 10 and the length of a portion facing the loop electrode 10.

It is desirable that the length of the loop electrode 10 has an electrical length less than the half wavelength of the operation frequency. Accordingly, the loop electrode functions as a magnetic field antenna. As long as the antenna is the magnetic field antenna, even if dielectric material such as water or the like is located near the antenna, the antenna is not susceptible to being affected thereby. Therefore, it is possible for the antenna to be attached to various kinds of articles including clothes and animals and used.

As illustrated above, the auxiliary electrode 20 is arranged so as to follow the outer side of the loop electrode 10, and hence the gain of the antenna is improved. While the gain of the antenna mainly depends on the shape of the loop electrode 10, when the auxiliary electrode 20 is located outside of the loop electrode 10, a radiation area, namely, the effective area of the antenna, becomes wide in a pseudo manner, and hence the antenna gain is improved.

In addition, the auxiliary electrode 20 is arranged so as to extend in a same direction in relation to the feeding point of the loop electrode 10, and hence a current flowing in the auxiliary electrode 20 flows in the same direction as a current flowing in the loop electrode 10, at a frequency deviated from the resonance frequency. Accordingly, a magnetic flux due to the loop electrode 10 is not cancelled out by a magnetic flux due to the auxiliary electrode 20, and it is possible to improve the antenna gain.

In addition, if the auxiliary electrode is connected to the vicinity of the feeding point of the loop electrode 10, the directions of the currents flowing in the loop electrode 10 and the auxiliary electrode 20 may be easily aligned in the same direction. Therefore, it is possible to further improve the antenna gain.

In addition, if the auxiliary electrode connected to the loop electrode 10 is single, it is possible to keep a loss to a minimum, and it is possible to further improve the antenna gain.

In addition, the antenna of the present preferred embodiment mainly obtains a gain as an antenna, from the loop electrode, and establishes the matching of impedance using the auxiliary electrode. Therefore, in terms of the improvement of the gain, it is desirable that the loop electrode is thickened.

Second Preferred Embodiment

Figure 6:
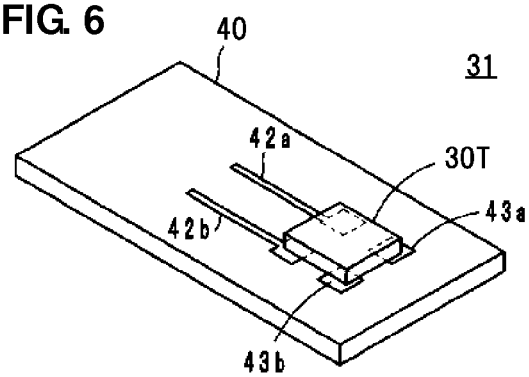
FIG. 6 is a perspective view of a wireless IC 31 according to a second preferred embodiment of the present invention.

FIG. 6 is the perspective view of a wireless IC 31 according to a second preferred embodiment of the present invention.

Figures 1A, 7:
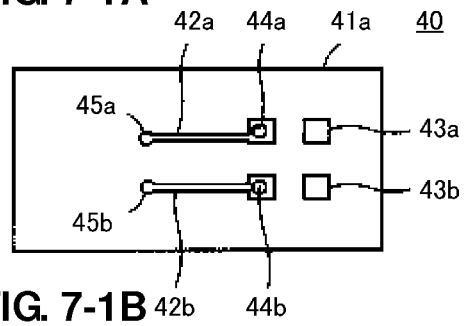
Figures 1B, 7:
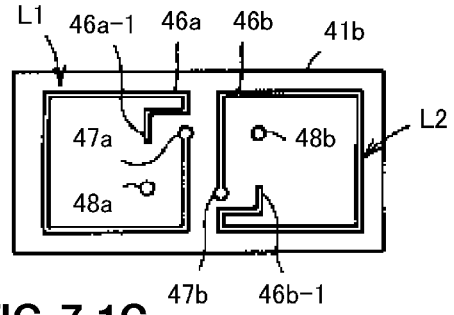

The example illustrated in FIGS. 1A and 1B is illustrated based on the assumption that the wireless IC 30 is a single semiconductor IC chip, for example. In the example in FIG. 6, the wireless IC 31 preferably includes a feed circuit substrate 40 and a wireless IC chip 30T. FIGS. 7-1A through 7-1H are diagrams illustrating the electrode pattern of each layer in the feed circuit substrate 40. FIG. 7-2 is an equivalent circuit diagram based on the feed circuit substrate 40 and a feed circuit.

The wireless IC chip 30T is mounted on the top surface of the feed circuit substrate 40. In such a state, the terminal electrodes of the wireless IC chip 30T are connected to terminal electrodes 43*a*, 43*b*, 44*a*, and 44*b* formed on the top surface of the feed circuit substrate 40.

FIGS. 7-1A through 7-1H are diagrams illustrating the electrode patterns of individual layers in the feed circuit substrate 40. The feed circuit substrate 40 is a multilayer substrate including dielectric layers 41*a* to 41*h*, in each of which a predetermined electrode pattern is formed. The dielectric layer 41*a* illustrated in FIG. 7-1A is the dielectric layer of an uppermost layer, and the dielectric layer 41*h* illustrated in FIG. 7-1H is the dielectric layer of a lowermost layer. Between the terminal electrode 44*a* and the terminal electrode 44*b*, a first coil L1 is defined by line electrodes 42*a*, 46*a*, and 42*b* and via electrodes 45*a*, 47*a*, and 48*a* in the dielectric layers 41*a* to 41*h*. In the same way, between the terminal electrode 44*a* and the terminal electrode 44*b*, a second coil L2 is defined by a line electrode 46*b* and via electrodes 47*b* and 48*b* in the dielectric layers 41*a* to 41*h*. In addition, the dielectric layers 41*a* to 41*h* are preferably made of ceramics, liquid crystalline polymers, or other suitable material, for example.

The terminal electrodes 43*a*, 43*b*, 44*a*, and 44*b* are formed on the layer shown in FIG. 7-1A. In addition, in the layer shown in FIG. 7-1A, the terminal electrodes 44*a* and 44*b* are connected to the via electrodes 45*a* and 45*b* using the line electrodes 42*a* and 42*b*, respectively.

In each of the layers illustrated shown in FIGS. 7-1B to 7-1H, the line electrodes 46*a* and 46*b* are individually formed. The first end portion 46*a*-1 of the line electrode 46*a* in the layer shown in FIG. 7-1B is conductively connected to the via electrode 45*a* in the layer shown in FIG. 7-1A. In the layer shown in FIG. 7-1B, the second end portion of the line electrode 46*a* is conductively connected to the via electrode 47*a*.

Figures 1C, 7:
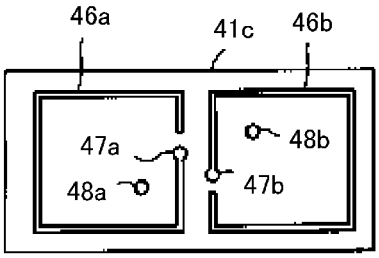
Figures 1D, 7:
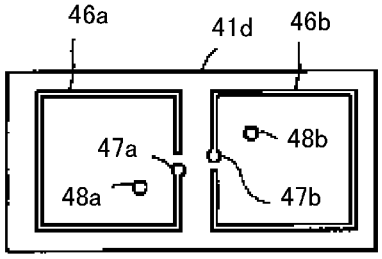
Figures 1E, 7:
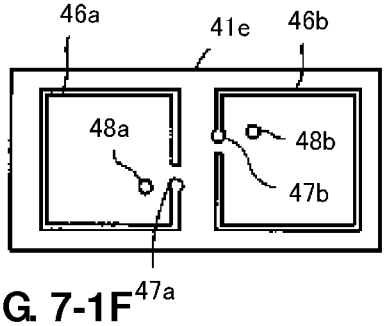
Figures 1F, 7:
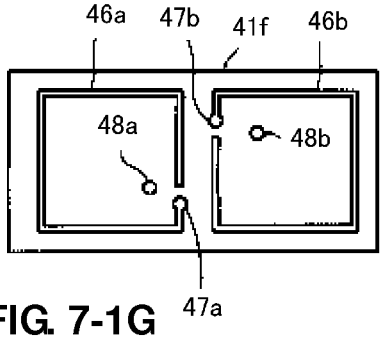
Figures 1G, 7:
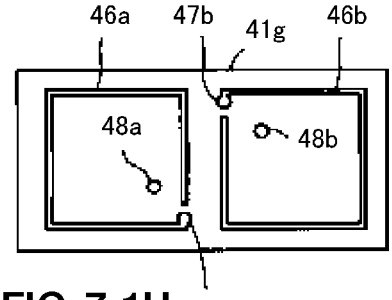
Figures 1H, 7:
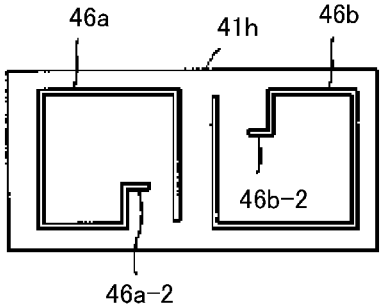
Figures 2, 7:
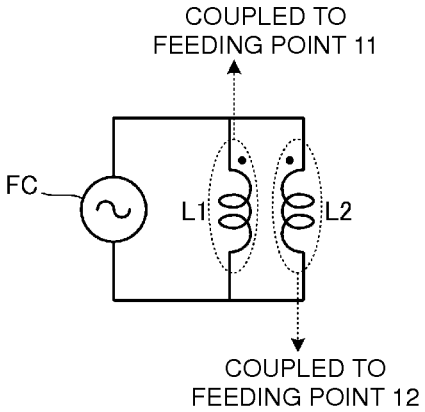

The first end portion of the line electrode 46*a* in each of the layers illustrated in FIGS. 7-1C to 7-1H is conductively connected to the via electrode 47*a* in the upper layer. In each of the layers illustrated in FIGS. 7-1C to 7-1H, the second end portion of the line electrode 46*a* is conductively connected to the via electrode 47*a*.

The second end portion 46*a*-2 of the line electrode 46*a* in the layer shown in FIG. 7-1H is connected to the via electrode 45*b* in the layer shown in FIG. 7-1A through the via electrode 48*a* in each of the layers illustrated in FIGS. 7-1B to 7-1G.

According to such a configuration as described so far, between the terminal electrodes 44*a* and 44*b*, a first coil of seven turns due to the line electrode 46*a* and the via electrodes 47*a* and 48*a* is preferably provided.

On the other hand, the first end portion 46*b*-1 of the line electrode 46*b* in the layer shown in FIG. 7-1B is conductively connected to the terminal electrode 44*b* in the layer shown in FIG. 7-1A. In the layer shown in FIG. 7-1B, the second end portion of the line electrode 46*b* is conductively connected to the via electrode 47*b*.

The first end portion of the line electrode 46*b* in each of the layers illustrated in FIGS. 7-1C to 7-1H is conductively connected to the via electrode 47*b* in the upper layer. In each of the layers illustrated in FIGS. 7-1C to 7-1H, the second end portion of the line electrode 46*b* is conductively connected to the via electrode 47*b*.

The second end portion 46*b*-2 of the line electrode 46*b* in the layer shown in FIG. 7-1H is connected to the terminal electrode 44*a* in the layer shown in FIG. 7-1A through the via electrode 48*b* in each of the layers illustrated in FIGS. 7-1B to 7-1G.

According to such a configuration as described so far, between the terminal electrodes 44*a* and 44*b*, a second coil of seven turns due to the line electrode 46*b* and the via electrodes 47*b* and 48*b* is preferably provided.

The wireless IC 31 illustrated in FIG. 6 adheres to the upper portions of the feeding points 11 and 12 of the loop electrode 10 illustrated in FIGS. 1A and 1B. Accordingly, the first coil and the feeding point 11 are electromagnetic-field-coupled to each other, and the second coil and the feeding point 12 are electromagnetic-field-coupled to each other.

As an equivalent circuit in FIG. 7-2, the feed circuit FC due to the wireless IC chip 30T is connected to the first coil L1 and the second coil L2. The first coil L1 is coupled to the feeding point 11, and the second coil L2 is coupled to the feeding point 12.

In addition, since the winding directions of the first coil and the second coil are opposite to each other, magnetic fields generated in the first and second coils (inductance elements) are cancelled out, and an electrode length to obtain a desired inductance value becomes long, a Q value is lowered. Therefore, since the steepness of the resonance characteristic of the feed circuit disappears, it is possible to obtain a wider bandwidth in the vicinity of a resonance frequency. It is desirable that the resonance frequency of the resonant circuit including the first coil and the second coil substantially corresponds to the communication frequency.

Since, in such a way, the feed circuit has the resonance frequency, it is possible to perform communication with a wide bandwidth, or it is possible to reduce the influence of a frequency deviation due to a target object to which a wireless tag is to be attached.

In addition, by providing the feed circuit substrate, it is easy to mount the wireless IC, compared with a case in which the wireless IC chip is directly mounted on the feeding point of the loop electrode. In addition, since the feed circuit substrate absorbs an external stress, it is possible to enhance the mechanical strength of the wireless IC.

While, in the above-mentioned example, the wireless IC preferably includes the wireless IC chip and the feed circuit substrate, the wireless IC may also include a pattern defining the feed circuit on the wireless IC chip with rewiring.

Third Preferred Embodiment

Figure 8:
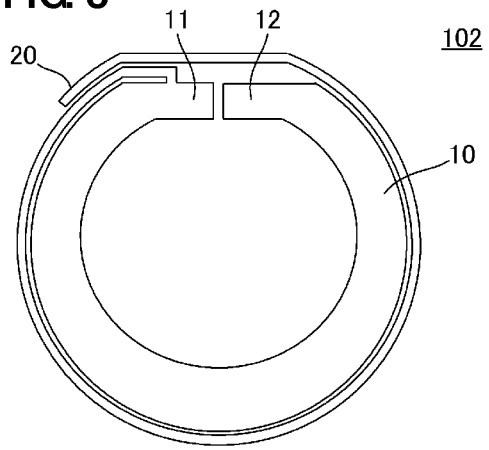
FIG. 8 is a plan view of an antenna 102 according to a third preferred embodiment of the present invention.

FIG. 8 is the plan view of an antenna 102 according to a third preferred embodiment of the present invention.

The antenna 102 illustrated in FIG. 8 includes the two feeding points 11 and 12, and includes the loop electrode 10 arranged in a loop shape and the auxiliary electrode 20 electrically connected to the loop electrode 10 and located at a position along the outer circumference of the loop electrode 10. The auxiliary electrode 20 is arranged along the outer circumference of the loop electrode 10 so as to circle the loop electrode 10 one time or more. In this way, the auxiliary electrode 20 may extend so as to circle the loop electrode 10 one time or more.

Figure 9A:
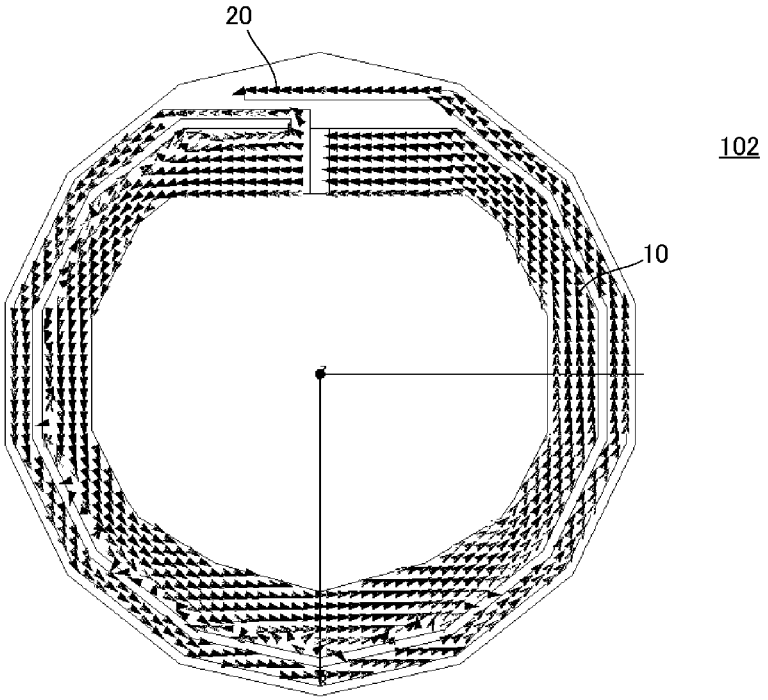
FIG. 9A is a diagram illustrating a distribution of current intensity of the antenna 102 according to the third preferred embodiment.

FIG. 9A is a diagram illustrating the distribution of the current intensity of the antenna 102 according to the third preferred embodiment. In this example, the directions of currents in individual portions are indicated by the directions of arrowheads, and current intensities are also indicated by the densities of arrowheads. In this regard, however, for the sake of simulation, in FIG. 9A, the loop electrode 10 and the auxiliary electrode 20 are expressed in polygonal shapes.

Figure 9B:
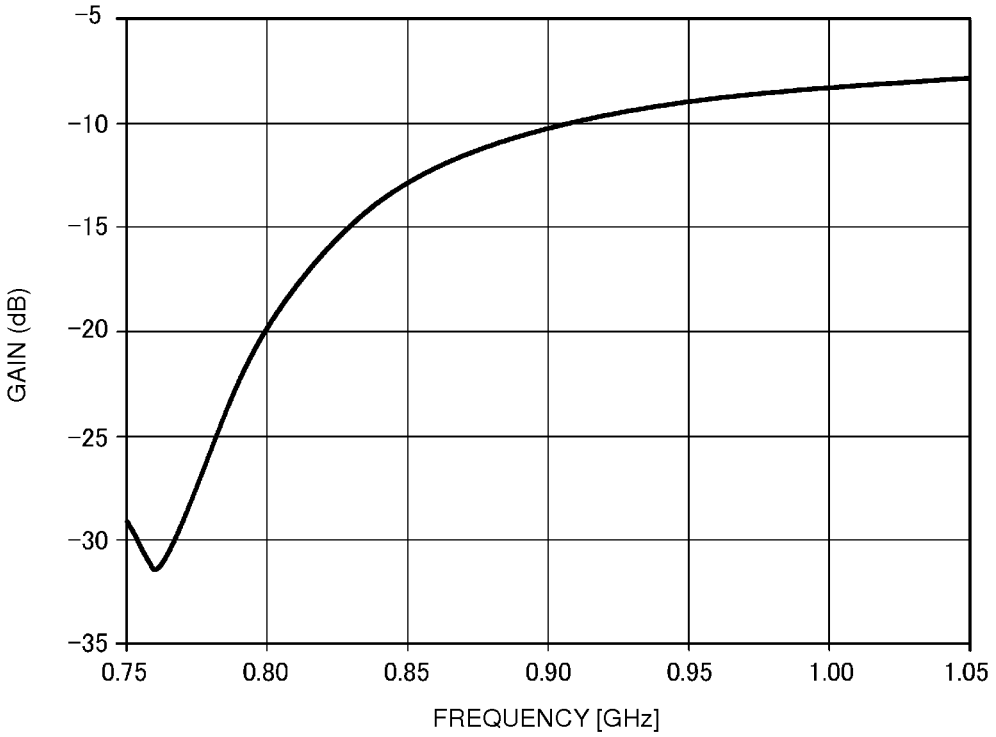
FIG. 9B is a diagram illustrating a frequency characteristic of an antenna gain of the antenna 102 according to the third preferred embodiment.

FIG. 9B is a diagram illustrating the frequency characteristic of the antenna gain of the antenna 102 according to the third preferred embodiment. In this way, the gain of about −9 dB is obtained at about 950 MHz corresponding to the operation frequency, for example.

Figure 10A:
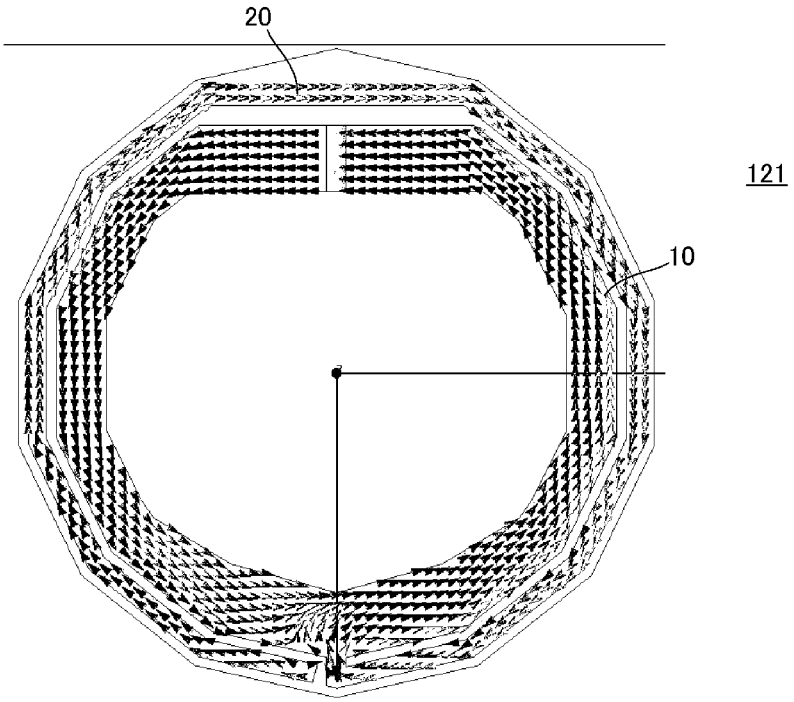
FIG. 10A is a diagram illustrating a distribution of current intensity of an antenna 121 that is a first comparative subject of the antenna 102 according to the third preferred embodiment.
Figure 10B:
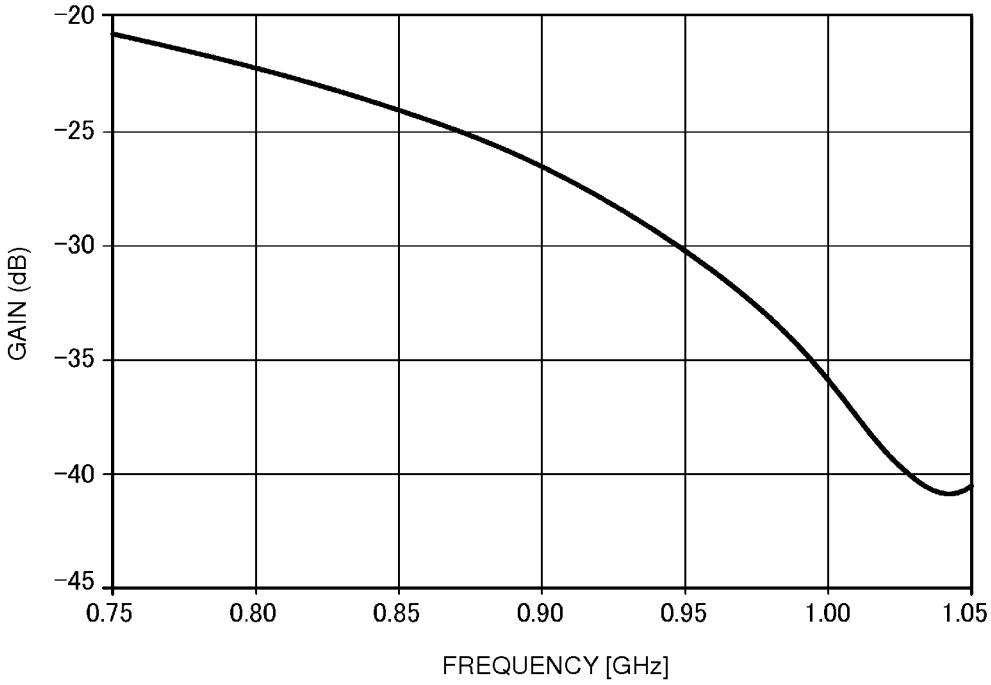
FIG. 10B is a diagram illustrating a frequency characteristic of an antenna gain of the antenna 121.

On the other hand, FIG. 10A is a diagram illustrating the distribution of the current intensity of an antenna 121 that is a first comparative subject of the antenna 102 according to the third preferred embodiment, and FIG. 10B is a diagram illustrating the frequency characteristic of the antenna gain of the antenna 121. In this way, when the connecting position (branching position) of the auxiliary electrode 20 is spaced away from the feeding point, since a portion occurs in which the directions of a current in the loop electrode 10 and a current in the auxiliary electrode 20 are opposite to each other, a gain is lowered. In the example in FIG. 10B, a gain of about −30 dB is only obtained at about 950 MHz, for example. As illustrated in FIG. 9A, when the connecting position is located near the feeding point, since the directions of a current in the loop electrode 10 and a current in the auxiliary electrode 20 are the same, a gain is improved.

Figure 11A:
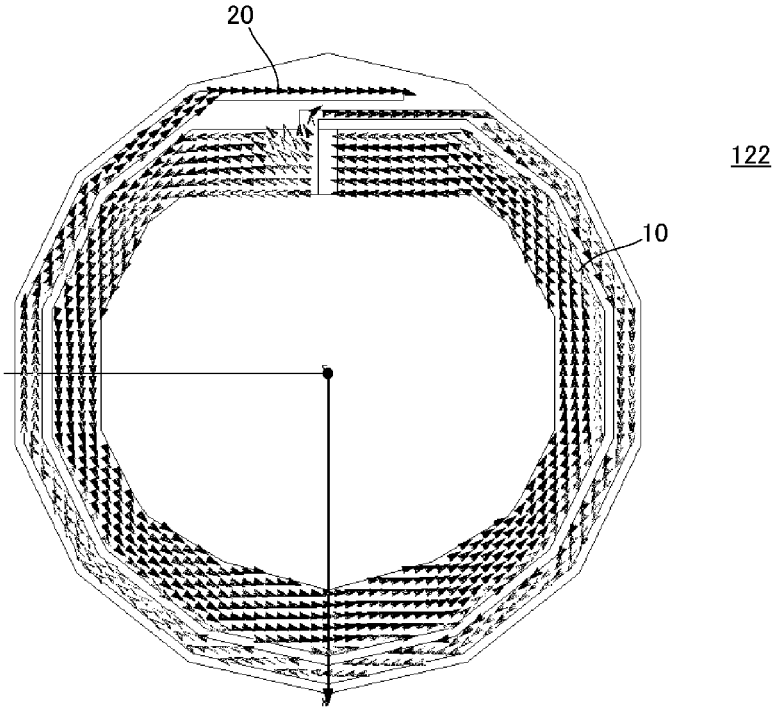
FIG. 11A is a diagram illustrating a distribution of current intensity of an antenna 122 that is a second comparative subject of the antenna 102 according to the third preferred embodiment.
Figure 11B:
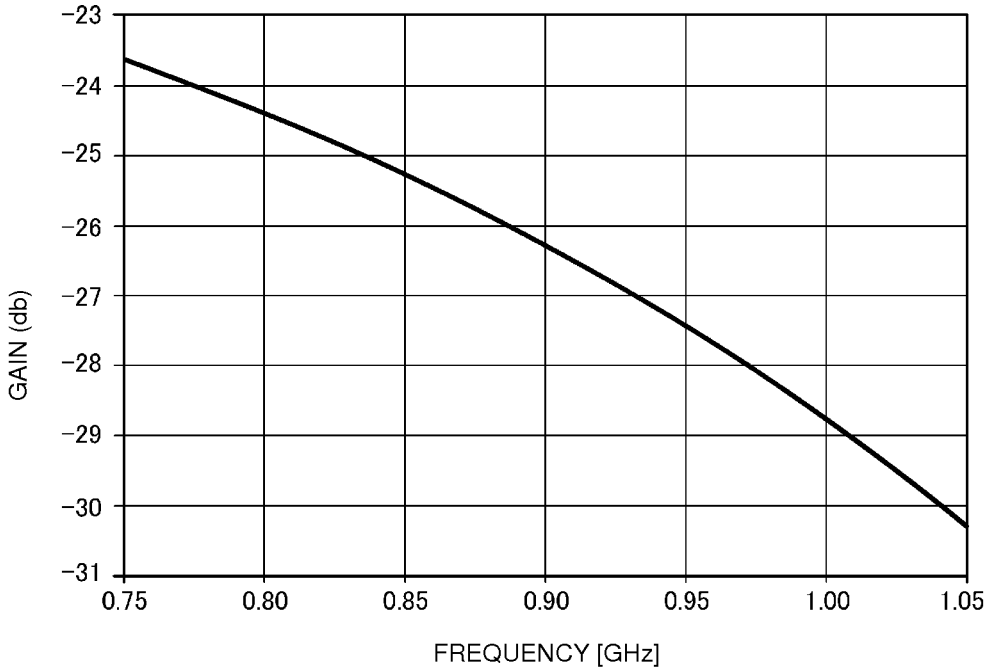
FIG. 11B is a diagram illustrating a frequency characteristic of an antenna gain of the antenna 122.

In addition, FIG. 11A is a diagram illustrating the distribution of the current intensity of an antenna 122 that is a second comparative subject of the antenna 102 according to the third preferred embodiment, and FIG. 11B is a diagram illustrating the frequency characteristic of the antenna gain of the antenna 122. In this way, when the auxiliary electrode 20 extends in a direction opposite to the loop electrode 10, since a portion occurs in which the directions of a current in the loop electrode 10 and a current in the auxiliary electrode 20 are opposite to each other, a gain is lowered. In the example in FIG. 11B, a gain of about −27 dB is only obtained at about 950 MHz. As illustrated in FIG. 9A, when the auxiliary electrode 20 extends in the same direction as the loop electrode 10 in relation to the feeding point, since the directions of a current in the loop electrode 10 and a current in the auxiliary electrode 20 are the same, a gain is improved.

Fourth Preferred Embodiment

Figure 12:
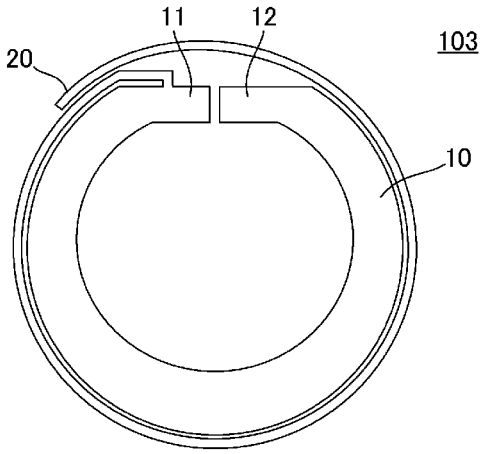
FIG. 12 is a plan view of an antenna 103 according to a fourth preferred embodiment of the present invention.

FIG. 12 is the plan view of an antenna 103 according to a fourth preferred embodiment of the present invention.

The antenna 103 illustrated in FIG. 12 includes the two feeding points 11 and 12, and includes the loop electrode 10 arranged in a loop shape and the auxiliary electrode 20 electrically connected to the loop electrode 10 and located at a position along the outer circumference of the loop electrode 10. While the auxiliary electrode 20 roughly follows the outer circumference of the loop electrode 10, the auxiliary electrode 20 does not follow the loop electrode 10 over the entire path. In the vicinity of the feeding points 11 and 12 of the loop electrode 10, the auxiliary electrode 20 defines a circular arc at a position away from the loop electrode 10. In this way, since the whole auxiliary electrode 20 has a circular arc shape, a pseudo radiation area is widened, and it is possible to improve a gain.

Fifth Preferred Embodiment

Figure 13:
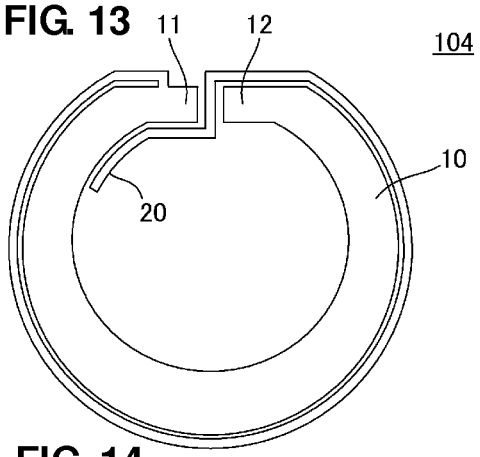
FIG. 13 is a plan view of an antenna 104 according to a fifth preferred embodiment of the present invention.

The antenna 104 illustrated in FIG. 13 includes the two feeding points 11 and 12, and includes the loop electrode 10 arranged in a loop shape and the auxiliary electrode 20 electrically connected to the loop electrode 10 and located at positions along the outer circumference and the inner circumference of the loop electrode 10. More specifically, the first end portion of the auxiliary electrode 20 is electrically connected to the vicinity of one feeding point 11 of the loop electrode, and arranged along the outer circumference of the loop electrode 10, and the second end portion of the auxiliary electrode 20 is arranged along the inner circumference of the loop electrode 10 so as to pass between the feeding points 11 and 12 of the loop electrode 10.

In this way, the leading end portion of the auxiliary electrode 20 may extend along the inner circumference of the loop electrode 10.

Sixth Preferred Embodiment

Figure 14:
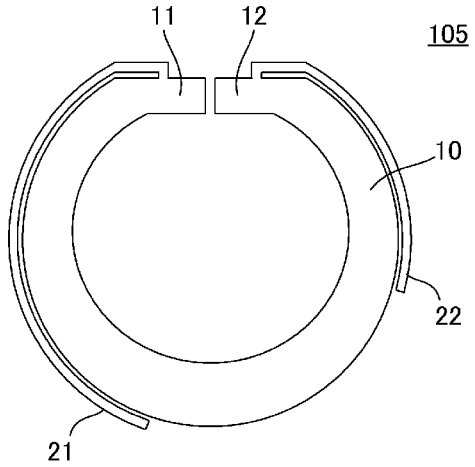
FIG. 14 is a plan view of an antenna 105 according to a sixth preferred embodiment of the present invention.

FIG. 14 is the plan view of an antenna 105 according to a sixth preferred embodiment of the present invention. While, in each of the first to fifth preferred embodiments, the example has been illustrated in which the single auxiliary electrode 20 is provided, two auxiliary electrodes are preferably provided in the sixth preferred embodiment.

The antenna 105 preferably includes the two feeding points 11 and 12, and includes the loop electrode 10 arranged in a loop shape and auxiliary electrodes 21 and 22 electrically connected to the vicinity of the feeding points 11 and 12 of the loop electrode 10 and arranged at positions along the outer circumference of the loop electrode 10.

The auxiliary electrodes 21 and 22 are disposed so as to follow the loop electrode 10. Even in such a shape, it is possible for the antenna 105 to be defined by the equivalent circuit illustrated in FIG. 3, and it is possible to obtain an advantageous effect due to the addition of the resonant circuit.

When there are two auxiliary electrodes, if the both thereof have the same electrical length, a small impedance change occurs between the case of one auxiliary electrode and the case of two auxiliary electrodes. On the other hand, when the electrical lengths of the two auxiliary electrodes are caused to be different from each other, the impedance of the antenna is effectively adjusted due to the action of each auxiliary electrode. In addition, the electrical lengths of the two auxiliary electrodes 21 and 22 may also be the same.

Seventh Preferred Embodiment

Figure 15:
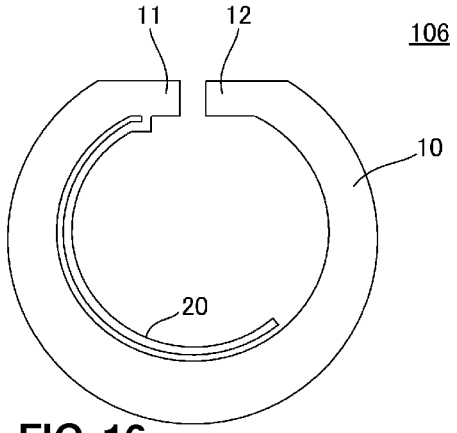
FIG. 15 is a plan view of an antenna 106 according to a seventh preferred embodiment of the present invention.

FIG. 15 is the plan view of an antenna 106 according to a seventh preferred embodiment of the present invention. In each of the first to sixth preferred embodiments, the first end portion of the auxiliary electrode 20 is preferably electrically connected to the outer side of the loop electrode 10. In the seventh preferred embodiment, the first end portion of the auxiliary electrode 20 is preferably arranged so as to be electrically connected to the inner side of the loop electrode 10 in the vicinity of one feeding point 11 of the loop electrode 10.

In this way, the auxiliary electrode 20 may also exist on the inner side of the loop electrode 10.

Eighth Preferred Embodiment

Figure 16:
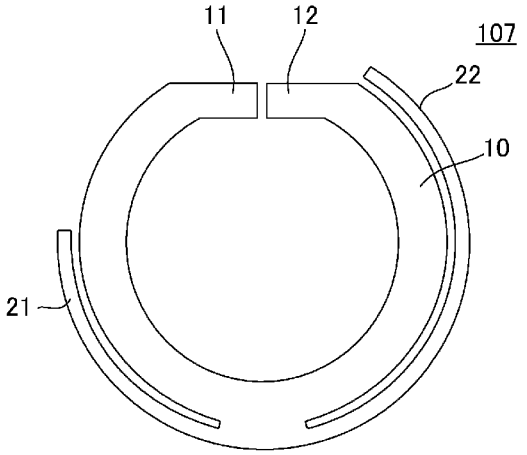
FIG. 16 is a plan view of an antenna 107 according to an eighth preferred embodiment of the present invention.

FIG. 16 is the plan view of an antenna 107 according to an eighth preferred embodiment of the present invention. In each of the first to seventh preferred embodiments, the auxiliary electrode is preferably arranged so as to be electrically connected to the vicinity of the feeding point of the loop electrode. In addition, the first end portion of the auxiliary electrode is electrically connected to the loop electrode, and the second end portion is open. In the eighth preferred embodiment, the auxiliary electrodes 21 and 22 are arranged so as to be electrically connected to near the center of the loop electrode 10. In addition, the two auxiliary electrodes 21 and 22 are arranged so as to be electrically connected to approximately the same position of the loop electrode 10. This shape may also be regarded as a shape in which the center (a position other than an end portion) of one auxiliary electrode is electrically connected to the loop electrode 10.

When there are the two auxiliary electrodes arranged in this way, if the electrical lengths of the two auxiliary electrodes are caused to be different from each other, the impedance of the antenna is effectively adjusted by the action of each auxiliary electrode. In addition, the electrical lengths of the two auxiliary electrodes 21 and 22 may also be the same.

Ninth Preferred Embodiment

Figure 17:
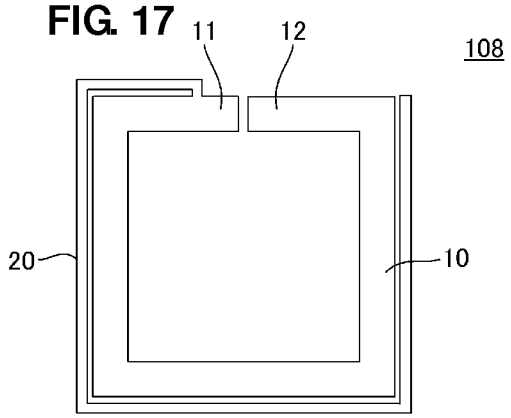
FIG. 17 is a plan view of an antenna 108 according to a ninth preferred embodiment of the present invention.

FIG. 17 is the plan view of an antenna 108 according to a ninth preferred embodiment of the present invention. In each of the first to eighth preferred embodiments, the loop electrode 10 and the auxiliary electrode preferably have circular shapes or circular arc shapes. In the eighth preferred embodiment, the loop electrode 10 and the auxiliary electrode 20 preferably have rectangular shapes, for example.

The loop electrode and the auxiliary electrode may not have curved shapes, and may also have polygonal shapes.

Tenth Preferred Embodiment

Figure 18:
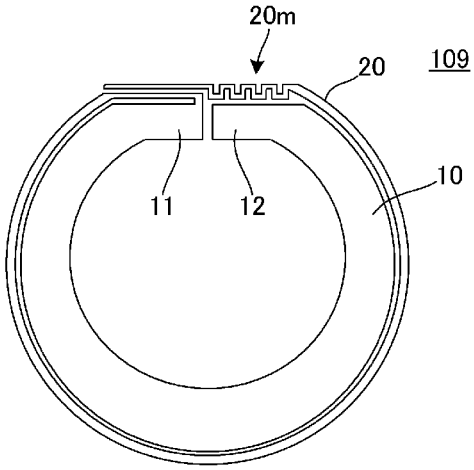
FIG. 18 is a plan view of an antenna 109 according to a tenth preferred embodiment of the present invention.

FIG. 18 is the plan view of an antenna 109 according to a tenth preferred embodiment of the present invention.

The antenna 109 illustrated in FIG. 18 includes the two feeding points 11 and 12, and includes the loop electrode 10 arranged in a loop shape and the auxiliary electrode 20 electrically connected to the loop electrode 10 and located at a position along the outer circumference of the loop electrode 10. A meander pattern 20*m* is provided in a portion of the auxiliary electrode 20. In this way, by providing the meander pattern in a portion of the auxiliary electrode 20, it is possible to set the impedance of the antenna to a predetermined value without the area of the antenna being increased.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna comprising:

a loop electrode including two feeding points and arranged in a loop shape; and an auxiliary electrode that is electrically connected to the loop electrode and located at a position along the loop electrode; wherein the auxiliary electrode extends in a same direction as the loop electrode in relation to at least one of the two feeding points;

the auxiliary electrode includes a first end connected to the loop electrode and a second end that is open;

the first end of the auxiliary electrode is directly physically and electrically connected to the loop electrode at an area of a first one of the two feeding points, and the auxiliary electrode is arranged to extend along the loop electrode towards a second one of the two feeding points;

a width of the auxiliary electrode is thinner than a width of the loop electrode;

a capacitance is produced between the loop electrode and the auxiliary electrode; and a parallel resonance is produced by an inductance of the auxiliary electrode, an inductance of the loop electrode, and the capacitance produced between the loop electrode and the auxiliary electrode.

2. The antenna according to claim 1, wherein the auxiliary electrode is located at a position along an outer circumference of the loop electrode.

3. The antenna according to claim 1, wherein the auxiliary electrode is the only auxiliary electrode provided in the antenna and is connected to an area of at least one of the two feeding points.

4. The antenna according to claim 1, wherein the auxiliary electrode includes two auxiliary electrodes having different lengths from each other.

5. The antenna according to claim 1, wherein the auxiliary electrode includes a meander pattern configuration in at least a portion thereof.

6. The antenna according to claim 1, wherein a resonance frequency of a circuit including the loop electrode and the auxiliary electrode is deviated from a communication frequency.

7. The antenna according to claim 1, wherein a resonance frequency of a circuit including the loop electrode and the auxiliary electrode is a frequency of a UHF band.

8. The antenna according to claim 6, wherein the communication frequency is a UHF band, and the resonance frequency of the circuit including the loop electrode and the auxiliary electrode is deviated to a frequency of about 30 MHz or more lower than the communication frequency.

9. A wireless IC device including the antenna according to claim 1, the wireless IC device comprising:

a wireless IC configured to perform power feeding on at least one of the two feeding points of the antenna.

10. The wireless IC device according to claim 9, wherein the wireless IC includes a feed circuit arranged to perform power feeding on the at least one of the two feeding points of the antenna and an IC chip arranged to perform power feeding on the at least one of the two feeding points of the antenna through the feed circuit.

11. The wireless IC device according to claim 10, wherein the feed circuit includes a resonant circuit whose resonance frequency substantially corresponds to a communication frequency.

12. The wireless IC device according to claim 10, wherein the feed circuit is provided in a feed circuit substrate and the IC chip is mounted in the feed circuit substrate.

* * * * *